United States Patent [19]

Braddick et al.

[11] Patent Number: 5,018,579

[45] Date of Patent: May 28, 1991

[54] ARRANGEMENT AND METHOD FOR CONDUCTING SUBSTANCE AND SEAL THEREFOR

[75] Inventors: Britt O. Braddick, Houston, Tex.; Michael Langer, Nienhagen, Fed. Rep. of Germany

[73] Assignee: Texas Iron Works, Inc., Houston, Tex.

[21] Appl. No.: 471,291

[22] Filed: Feb. 1, 1990

[51] Int. Cl.[5] ..... E21B 33/16

[52] U.S. Cl. ..... 166/291; 166/153; 166/155

[58] Field of Search ..... 166/291, 153–156, 166/192, 208

[56] References Cited

U.S. PATENT DOCUMENTS

| | | | |
|---|---|---|---|
| 3,223,170 | 12/1965 | Mott | 166/208 |
| 3,364,996 | 1/1968 | Brown | 166/120 |
| 3,472,520 | 10/1969 | Burns | 277/116.2 |
| 3,545,542 | 12/1970 | Scott | 166/155 |
| 3,635,288 | 1/1972 | Lebourg | 166/156 |
| 3,777,819 | 12/1973 | Delano | 166/285 |
| 3,796,260 | 3/1974 | Bradley | 166/153 |
| 3,993,128 | 11/1976 | Braddick | 166/216 |
| 4,010,804 | 3/1977 | Garcia | 166/315 |
| 4,042,014 | 8/1977 | Scott | 166/0.5 |
| 4,047,566 | 9/1977 | Duke | 166/285 |
| 4,060,131 | 11/1977 | Kenneday et al. | 166/315 |
| 4,281,711 | 8/1981 | Braddick et al. | 166/118 |
| 4,562,889 | 1/1986 | Braddick | 166/381 |
| 4,624,312 | 11/1986 | McMullin | 166/155 |
| 4,671,358 | 6/1987 | Lindsey, Jr. et al. | 166/291 |
| 4,688,642 | 8/1987 | Baker | 166/382 |
| 4,809,776 | 3/1989 | Bradley | 166/155 |
| 4,836,279 | 6/1989 | Freeman | 166/153 |
| 4,842,069 | 6/1989 | Baugh et al. | 166/155 |
| 4,920,075 | 11/1975 | Braddick et al. | 166/290 |
| 4,934,452 | 6/1990 | Bradley | 166/155 |

FOREIGN PATENT DOCUMENTS

WO89/01562 2/1989 PCT Int'l Appl. .

OTHER PUBLICATIONS

"RP Liner Setting Assembly Used for Rotate & Reciprocate Cementing", Texas Iron Works, Inc. 80–81 Catalog, p. 6850.

"RRP Liner Setting Assembly for Extended Rotation", Texas Iron Works, Inc. 1982–83 Catalog, p. 7914.

C. R. Hyatt and M. H. Partin, Jr., "Liner Rotation and Proper Planning Improve Primary Cementing Success", Texas Iron Works, Inc. SPE 12607 Reprint, SPE Deep Drilling and Production Symposium, Amarillo, Tex., Apr. 1–3, 1984.

Juan A. Garcia, "Rotating Liner Hanger Helps Solve Cementing Problems", reprinted by Petroleum Engineer International, Sep., 1985, expressly for Texas Iron Works, Inc.

API Bulletin D17, "Running and Cementing Liners in the Delaware Basin, Tex.", First Edition, Dec., 1974.

(List continued on next page.)

*Primary Examiner*—Bruce M. Kisliuk

*Attorney, Agent, or Firm*—Jack W. Hayden

[57] ABSTRACT

A well bore operating string has upper and lower wipers thereon with the wipers releasably connected by a frangible member for releasing the wipers in response to pressure in the operating string. Seals are provided to close off communication from the operating string bore to confine the pressure present in the operating string in a manner to assure release of the wipers as and when desired and in a sequence as may be desired. Upper and lower pump down plugs sealably seat, respectively, in the upper and lower wipers to form a movable, mechanical barrier to isolate or wipe ahead of and behind a substance for movement through the operating string and subsequent discharge into the well bore.

The wipers are each connected to the operating string to prevent relative rotation therebetween to further reduce the possibility of malfunction or improper functioning in releasing the wipers.

91 Claims, 10 Drawing Sheets

OTHER PUBLICATIONS

H. Ed Lindsey, "Liner Cementing Equipment and Techniques", Southwestern Petroleum Short Course Association, 1977.

H. E. Lindsey, Jr., "New Tools Make Liner Rotation During Cementing Practical", Reprinted from World Oil, Oct. 1981.

H. E. Lindsey, Jr., "Recent Developments in Tools for Liner Movement During Cementation", Southwestern Petroleum Short Course Association, 1981.

W. T. Lee and W. D. Dorge, "Cementing—Simultaneous Rotation—Reciprocating Technique (ROTO-TEK System)", IADC/SPE 11419, IADC/SPE 1983 Drilling Conference, New Orleans, La., Feb. 20–23, 1983.

W. R. Landrum and R. D. Turner, "Rotating Liners During Cementing in the Grand Isle and West Delta Area", IADC/SPE 11420, IADC/SPE 1983 Drilling Conference, New Orleans, La., Feb. 20–23, 1983.

R. Buchan and M. T. S. Little, "Innovative Techniques Improve Liner Cementation in North Sea Wells: An Operator's Experience", SPE 15896, SPE European Petroleum Conference, London, Oct. 20–22, 1986.

M. A. Arceneaux and R. L. Smith, "Liner Rotation While Cementing: An Operator's Experience in South Texas", SPE/IADC 13448, SPE/IADC 1985 Drilling Conference New Orleans, La., Mar. 6–8, 1985.

H. E. Lindsey, Jr., "Rotate Liners for a Successful Cement Job", World Oil, Oct., 1986.

H. E. Lindsey, Jr. and K. S. Durham, "Field Results of Liner Rotation During Cementing", SPE 13047, 59th Annual Technical Conference and Exhibition, Houston, Tex., Sep. 16–19, 1984.

Joe Gibbs, "How to Rotate and Reciprocate While Cementing Your Liner", Drilling-DCW, Jun. 1974.

James L. Cowthran, "Technology Used to Improve Drilling Performance and Primary Cementing Success in Katy Field", SPE 10956, 57th Annual Fall Technical Conference and Exhibition, New Orleans, La., Sep. 26–29, 1982.

Kyle S. Graves, "Planning Would Boose Liner Cementing Success", Technology, Apr. 15, 1985, Oil and Gas Journal.

Rpd Bennett, "Tapered Roller Bearing Enhances Rotating Liner Hanger Performance", Sep., 1985.

ARRANGEMENT AND METHOD FOR CONDUCTING SUBSTANCE AND SEAL THEREFOR

CROSS-REFERENCE TO RELATED APPLICATIONS

The present patent application relates to co-pending application Ser. No. 07/348,221 filed May 9, 1989 for "Cementing Method and Arrangement", a continuation of applicant's prior co-pending application Ser. No. 07/147,701 filed Dec. 4, 1987 now abandoned; and co-pending application Ser. No. 07/471,292 filed Feb. 1, 1990 for "Arrangement and Method for Conducting Substance and Lock Therefore".

STATEMENT OF THE PRIOR ART

So far as known to applicants, in dual or tandem plug and wiper arrangements that are connected to an operating string, there are presently no seals to confine the fluid or to prevent the fluid from leaking out of the operating string to a surrounding tubular member or to the well bore adjacent where the first and second, or lower and upper wiper means are connected to the operating string. Thus fluid pressure in the operating string is effective, or is communicated to act on the outwardly extending, annular seals of the first or lower liner wiper means which sealingly engage with a surrounding tubular member. The cross-sectional area of the lower wiper means within the tubular member which is responsive to the fluid pressure from the operating string requires that the shear pins in present dual or tandem plug and wiper arrangements be strong enough to prevent premature release of the first or lower liner wiper means and its plug from the operating string. In attempting to prevent premature wiper release, by increasing the strength of the shear pin creates, in some instances, additional problems in that the shear pin strength may approach the tensile strength of the operating string which could be undersirable.

The prior art tandem plug arrangements known to applicants do not provide a construction wherein a closed fluid pressure system is provided to assure that the fluid pressure in the operating string is prevented from acting on the upper or lower liner wipers in a manner which may cause malfunction. In U.S. Pat. No. 3,635,288, operating string pressure is effective on wiping element 98 and where the pressure is sufficient, the wiping ribs 98 will fold back so pressure can be communicated through ports 23 to act on wiper element 36 to also fold the ribs 38 back. If operating string pressure bypasses wiper 36, the system malfunctions.

Additionally, the increase in the effective cross-sectional area on the annular wiper seals which is responsive to the pressure in the operating string is such that the resulting force necessary to shear the lower wiper free from the operating string may not always be restrained by the outwardly annular seals of the wiper means and such force may, in some instances, fold the seals back upon themselves which permits the pressure to by-pass the seals and cause a malfunction in the release of the wiper from the operating string.

Generally speaking the lower or first wiper is secured to the operating string, as is the upper or second wiper means in present dual, or tandem plug arrangements and the lower wiper means is supported within the bore of the upper wiper means. Where the operating string and the tandem plug arrangements supported thereon is rotated or reciprocated before or during the cementing operations prior to release of the respective wiper and plug means therefrom, sediment or other foreign substance in the well bore may be collected on the ribs of the wipers, or otherwise effect premature release of the first or lower wiper means so as to cause improper functioning of the tandem plug arrangement. To overcome this problem, it is suggested in U.S. Pat. No. 4,836,279 issued on June 6, 1989 that the lower and upper plugs be interlocked to prevent relative rotation therebetween. However, this could be disadvantageous since the upper wiper means is in turn releasably supported on the operating string by shear pins so that if contaminants in the fluid in the well bore should interfere with rotation of the operating string and the plug, then the upper wiper means may, in some circumstances be prematurely released.

Various substances may be introduced into a well bore either in oil or gas operations or in other operations such as mining operations wherein fluid is conducted into subterranean formations from which the recovery or placement of minerals is anticipated or for treating selected areas of the cavity or well bore in which the operations are conducted. Heretofore, so far as known to applicants, no satisfactory arrangement has been provided for assuring that the substance conducted into the well bore through an operating string will be isolated or maintained within the operating string or prevented from communicating with the well bore or surrounding tubular member so that the substance is discharged only at the location in the subterranean formation as desired. If the substance conducted through the operating string is such that it presents ecological or environmental problems to formations in the earth, it may be extremely desirable to retain such substance confined to avoid polluting or otherwise adversely affecting other geological formations through which the well bore extends.

Other problems have arisen in connection with conducting a substance, by way of example only, such as cement into a well bore.

Where a tubular member forms an extension of a sheath in an opening, such as for example, an extension of the casing, normally termed a liner, which is secured to the casing in a well bore and extending therefrom, it is generally accepted practice to seal around the liner in the opening or well bore and adjacent the lower end of the sheath or casing with cement or any other suitable substance. Such operation is generally referred to as single stage cementing to distinguish from those situations in which cementing operations are conducted in more than one stage or sequence.

It is preferable that in such cementing operations the cement which is provided to the cementing region in the opening, or well bore be isolated as it is conducted through the opening or well bore to the cementing region to avoid contamination by other fluids in the opening or well bore to obtain a uniform consistency of cement and hence a better cement protective sheath in the cementing region.

To attempt to accomplish such isolation, various plug and wiper arrangements have been proposed and used such as shown in various patents; however, it is believed that possible malfunction of the above present state of the art, as known to applicants, could cause problems in cementing operations.

For example, if the plug and wiper means do not operate in proper sequence to isolate both ahead of and behind the cement as it is conducted through the operating string into the opening or well bore, contamination of the cement may occur. Also, premature release between the wiper means and its respective engaged plug means as they move through the operating string and the liner to discharge the cement from the liner for cementing the liner in the well bore may cause contamination of the cement. The resilient ribs associated with the wiper means may not properly contact the operating string or the liner so as to possibly permit by-pass of cement therearound. Failure of the first or lower pump down plug to release from the lower liner wiper plug after they are pumped through the liner and seated in landing collar could result in the liner being left full of cement.

To isolate the cement as it is conducted through an operating string to the cementing region, it is customary to releasably support two spaced plug means with resilient wiper means thereon at the earth's surface for release into the operating string for providing a means of separating drilling fluids from cement both ahead of and behind the cement as it is pump down the operating string. It is intended that the spaced plug means sequentially and independently engage spaced wiper means releasably on the operating string so that the wiper means may be sequentially and independently released from the operating string without effecting release prematurely of the other liner wiper means from the operating string. The spaced liner wiper means and their respective engaged plug means seal ahead of and behind the cement as it is pumped, and discharged, into and through the liner into the cementing region.

U.S. Pat. Nos. 3,364,996; 3,635,288; and 4,671,358 typify the prior art as known to applicants, and Pat. Nos. '996 and '358 have reduced diameters in the bore of the second, or upper liner wiper means for receiving the second plug means therein after the first plug and liner wiper means hopefully have been successfully engaged together and released from the operating string by fluid pressure in the operating string. The first, or lower liner wiper means, of each the Pat. Nos. '996 and '358 has an extension extending up into the bore of the second or upper liner wiper means and is releasably secured in such bore above the smaller internal diameter seat formed therein for receiving the second plug means.

The Lindsey device of patent '358 has collets on the extension of the first wiper means which extend into the bore of the upper wiper means and the extension is secured above the smaller diameter seat contact or engage the reduced diameter on the second wiper means after release of the lower wiper means. The collets are supposed to collapse inwardly, by such contact with the seat in the bore of the upper wiper means to enable the extension to move past and out of the bore of the upper wiper means. Similarly, the extension of Brown's '996 first liner wiper means must clear the smaller diameter shoulder 36 in the bore of the upper liner wiper for the lower liner wiper means to successfully and independently release.

Contaminants in the fluid in the operating string ahead of the cement or other factors may prevent unrestricted movement of the first wiper means extension through such smaller diameter portions in the second wiper means, thus possibly causing premature release of the second liner wiper means at the time as the first or lower liner wiper means is attempting to release from the operating string and the second, or upper wiper means or causing the first wiper and its plug to hang up in the second wiper.

Also, the inwardly projecting finger 50 of Brown may interfere with proper seating of the second plug on shoulder 36 in the bore of the second wiper means.

In the prior art, so far as known to applicants, the first or lower liner wiper means is releasably secured with the first plug engaged therewith but there is no arrangement to lock them in such relationship until they reach a predetermined location in the liner. Thus, a malfunction, such as increased pressure in the operating string may prematurely release the first plug from the first or lower liner wiper means prematurely which is undesirable. Also, such arrangement does not provide a safety back pressure means in addition to the set shoe or a float collar that may be normally provided in a liner cementing operation.

U.S. Pat. No. 3,635,288 also shows a lower wiper which means extends through the upper wiper means to enable it to be releasably secured by the shear pins 20 above the lower end of the upper wiper means and above the resilient rib means on the upper liner wiper plug. However, there is no reduced restriction in the bore of the upper wiper means as there is in Brown or Lindsey patents.

Some prior art provides external catching means to hopefully catch the upper plug means on the upper drill string wiper means so it may engage with the upper liner wiper means for release with the upper liner wiper means by pressure in the operating string thereabove. However, such device must function in the hostile environment in the well bore which may be several miles deep in the earth and there is no assurance that the device will function safely and properly in such hostile environment.

SUMMARY OF THE INVENTION

The present invention provides seals in a tandem wiper and plug arrangement supported on an operating string to confine the fluid in the operating string and wipers supported on the operating string to prevent communication of fluid, after the drill pipe slugs have seated, from the operating string to the external seals on the upper and lower wipers to prevent malfunction in release of the wipers. Also, the effective cross-sectional area responsive to the fluid pressure to release the lower or first wiper means from the operating string is approximately the cross-sectional area of the operating string rather than the cross-sectional area of the external annular resilient ribs on the wiper. In the tandem plug arrangement of the present invention, the upper and lower wiper means are each secured to the operating string to prevent relative rotation between either wiper or between either wiper and the operating string.

An object of the present invention is to provide a tandem plug arrangement to provide a means of mechanical isolation or mechanical barrier ahead of and behind a substance as it is conducted through operating string and a well bore to assure that the substance is isolated and released from the operating string to the well bore in a desired manner.

Yet a further object of the present invention is to provide seals between an operating string and supported wiper means thereon so as to confine the fluid pressure after seating drill pipe wiper plugs therein for releasing the wiper means from the operating string in a desired manner.

Yet a further object of the present invention is to connect the operating string with dual wiper means in a manner to inhibit premature release of the wiper means from the operating string.

Still another object of the present invention is to provide seals in a dual wiper means arrangement, supported on an operating string so as to reduce the effective cross-sectional area responsive to fluid pressure in the operating string for release of the wiper means from the operating string to assist in assuring proper functioning and release of the wiper means from the operating string in a desired manner.

Still another object of the present invention is to provide an arrangement for assuring that a substance conducted through an operating string into a well bore is confined to be released therefrom at a selected or desired manner.

The present invention provides a construction wherein the operating string extends through the second or upper wiper means and terminates in overlapping relation with the first, or lower wiper means for releasably securing with the first or lower wiper means. This provides a construction wherein the lower wiper means is secured below the smallest internal diameter that may be present in the upper wiper means to assist in preventing premature release of the upper means. It also enables the longitudinal bore of the lower wiper means to orginate and extend away from adjacent the lower end of the upper wiper means rather than providing an extension with a bore that extends up into the upper wiper means, thus inhibiting premature release of the upper wiper means when the lower wiper means is released from the operating string. It also contemplates a construction wherein the upper wiper means is provided with a portion extending through the operating string and into the bore thereof which provides a seat for engaging the upper plug means with the upper wiper means, but the lower wiper means is secured below such restriction to avoid hanging upon the seat and causing premature release of the upper wiper means. It further provides a means for releasably securing the first or lower wiper means to the operating string adjacent the lower end of the second, or upper wiper means and below the second or upper wiper means to assist in proper and independent release sequencing of the engaged lower wiper means and its plug as well as the upper wiper means and its plug.

Another object of the present invention is to provide means for locking the lower wiper means with its plug means as they move through the liner to a predetermined position to prevent premature disengagement of the lower wiper means from its plug and premature release of the cement thereabove until the wiper means is seated at the predetermined position. Such construction also provides an additional backpressure safety valve to prevent reverse flow into the liner in addition to the set shoe or float collars normally associated with the liner.

Yet a further object of the present invention is to provide an arrangement for locking or latching a lower wiper means and its plug in position in the liner so that the upper wiper means and its plug may be locked or latched thereto after they have performed their function to assist in milling or drilling the wiper means and plug means out of the liner after the completion of the cementing operation.

The present invention provides a method for cementing the liner wherein seal means seal between the liner and operating string and the liner wherein seal means seal between the liner and operating string and the liner can be positioned for supporting or hanging on the casing. Plug means with resilient rib means thereon wipes the operating string ahead of and behind the cement and sealably engages with its corresponding wiper means to effect release of the wiper means from the operating string and each plug and its wiper means jointly form a movable barrier or seal as they move ahead of and behind the cement as the cement or fluid moves through the liner to the location desired. The liner support means includes means for hydraulic or mechanical actuation and may include one or more liner hangers and where multiple hangers are used means are employed for simultaneously setting all of them to distribute the load of the liner thereamong. The support means also includes means for rotating or reciprocating the liner before setting, and rotating after setting the liner in the well bore casing.

Other objects and advantages of the present invention will become readily apparent from a consideration of the following drawings and description.

DESCRIPTION OF THE PREFERRED EMBODIMENTS

The present invention will be described in detail in connection with its use for cementing a liner in a well bore wherein cement is conducted through the operating string OS to be discharged therefrom and through the lower end of a liner into the well bore surrounding the liner.

However, it should be understood that such description is for purposes of illustration only and that the present invention may be employed in any situation where it is desired to conduct a substance through an operating string and liner into a cavity or well bore in the earth's surface and for discharging the substance from the operating string into the well bore. The present invention provides a mechanical barrier to isolate the substance as it is conducted through the operating string and liner to inhibit contact between such substance and other well fluids while such substance is being conducted through said operating string and liner to the location where it is desired to discharge the substance into the well bore. The present invention also controls the release of suitable seal means that is conducted through the well bore to assist in isolating the substance as it is conducted through the well bore and to assure that the seals function in a desired manner to accomplish the intended results.

Attention is first directed to FIGS. 1–5 inclusive of the drawings wherein a well bore annulus is represented by the letters WB having a casing C therein terminating as represented at E in the well bore WB. An operating string such as a drill string or tubing string extends from the earth's surface and is represented by the letters OS and has a portion which may be referred to as a tail pipe 25 which extends through the seal means S and seals between the operating string OS and the liner L and the releasable means R which releasably secure the operating string OS and the liner L together for lowering into the well bore WB and for conducting operations to position the liner L therein as will be explained.

Figure 1:
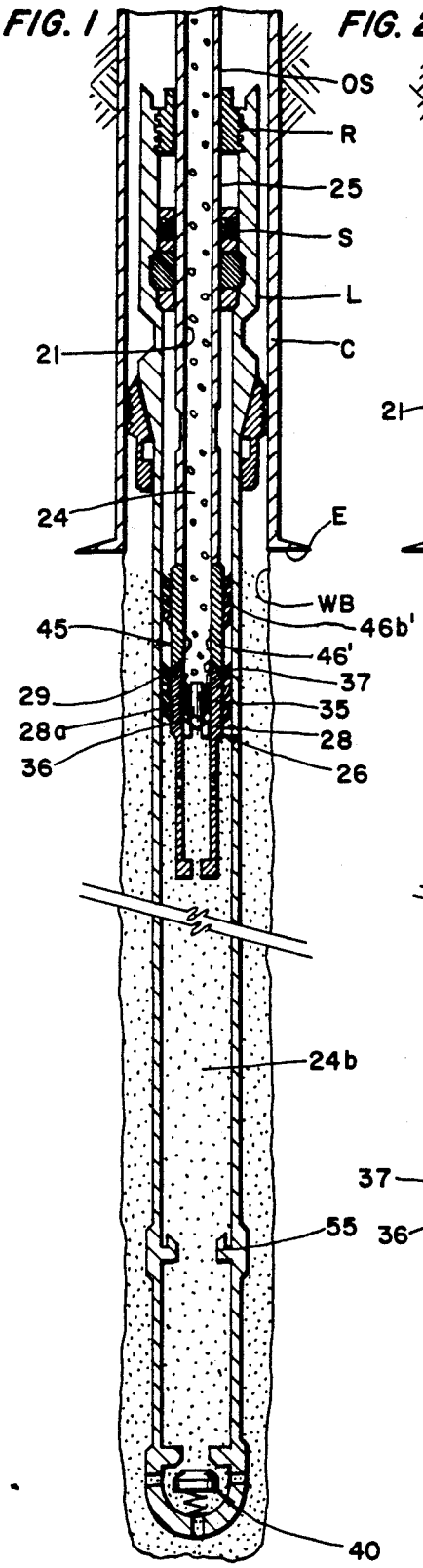
FIGS. 1–5 inclusive are schematic illustrations of an operating string releasably and sealably secured with a liner in a well bore casing and demonstrating the sequential actuation of the separate plug and wiper means for isolating cement, or a substance as it is conducted through the operating string and liner to a selected region in a well bore and sealing off the lower end of the liner against backflow from the well bore.
Figure 7:
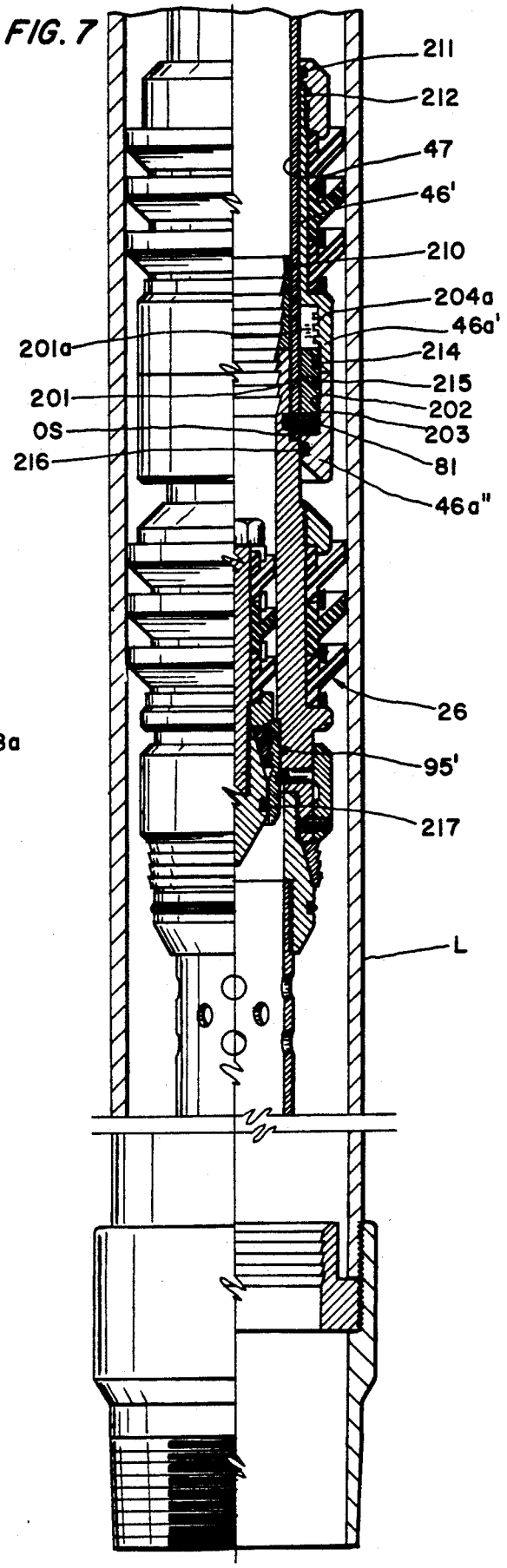
FIG. 7 is a sectional view partly in elevation illustrating the first pumpdown plug means sealably engaged and locked with the first or lower liner wiper means prior to release from the operating string.

A first wiper means, or lower liner wiper means is schematically illustrated in FIGS. 1–5 at 26 and a first or lower pump down plug means is schematically illustrated in FIG. 1 at 35 as sealably engaged within the bore 28*a* of body 28 of the first wiper means 26. External seals or wipers 29 are mounted on body 26 and extend outwardly therefrom. The first pump down plug means includes a solid or closed body schematically represented at 36 with annular seals or resilient wipers 37 spaced longitudinally therealong and extending outwardly or projecting therefrom as shown for sealably engaging with the bore 21 of the operating string OS to form a movable seal, or barrier, in the operating string OS ahead of the cement, or substance, and any cleaning, conditioning or spacer fluids that may precede the cement for conditioning of the well bore prior to discharge of the cement, or substance, into the region to receive the substance or cement. The first wiper means 26 and first plug means 35 when sealably engaged together as illustrated in FIG. 7 are responsive to pressure in the operating string OS and release the wiper means 26 from the operating string to form a movable mechanical barrier or seal means for moving ahead of the cement, or substance, as they move through the liner L. Thus, such arrangement enables the plug means to first wipe the bore of the operating string OS ahead of the cement, displacing any fluid which precedes it, and then after the first wiper means 26 has been released from the operating string OS, as will be described, it and the first plug means move through the liner L and form a movable mechanical barrier or seal with the bore wall of the liner which enables the liner wall to be also wiped prior to discharge of the fluid and cement thereinto and therethrough.

Figure 2:
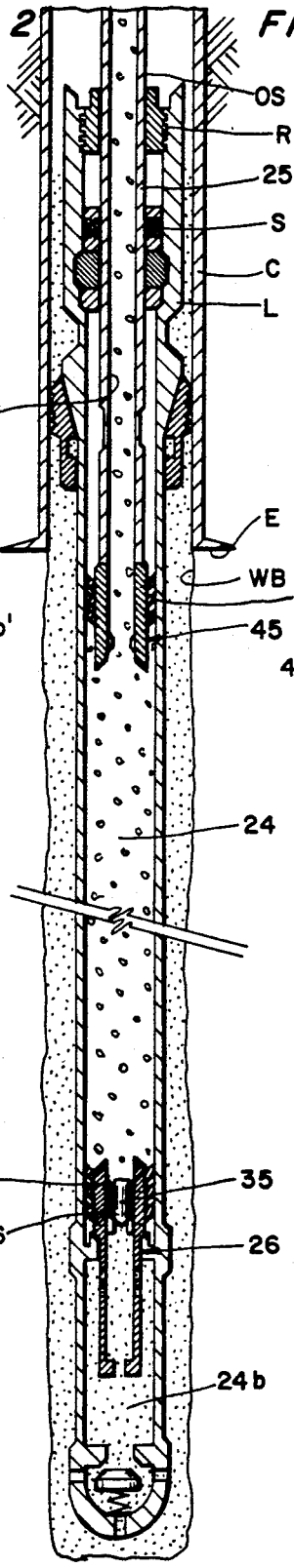
Figure 3:
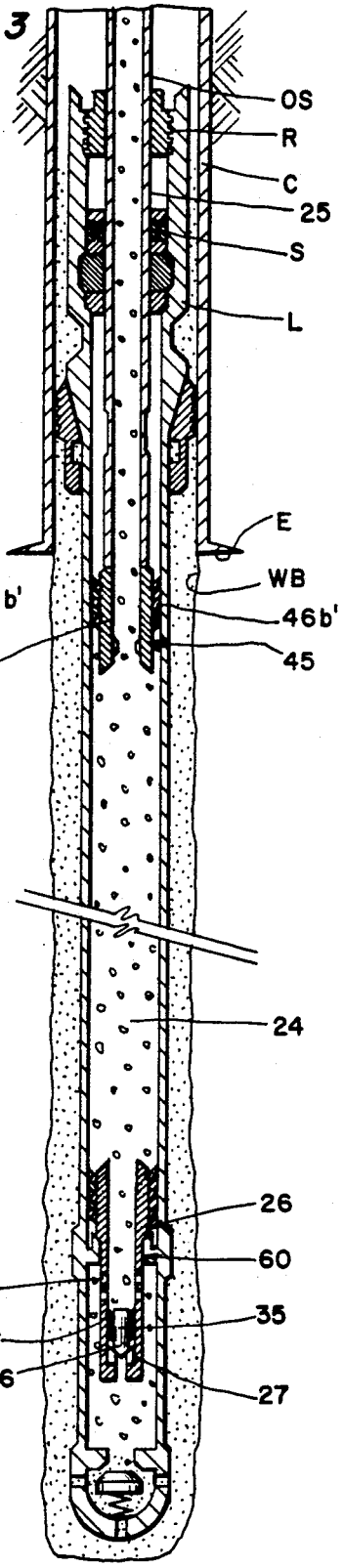
Figure 4:
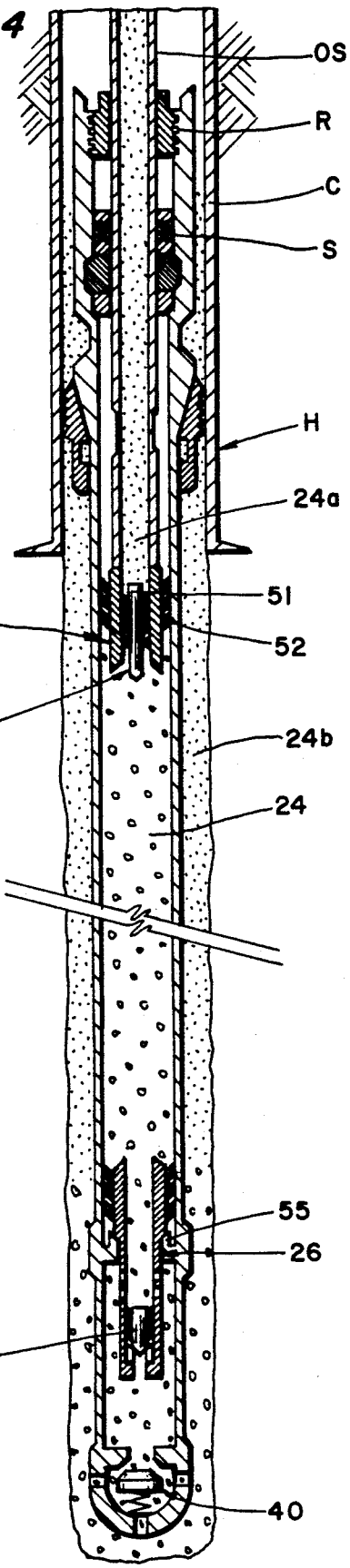

Second or upper wiper means is schematically illustrated in FIGS. 1-5 at 45 with resilient means 46b' mounted on body 46' of the upper wiper 45. The second wiper means is also releasably secured with the operating string OS. As shown in FIG. 4 a second or upper cement plug schematically represented at 50 includes a plug body 51 and external seal or wiper means 52 on body 51 of similar configuration or of suitable configuration generally similar to that described with regard to plug means 35 to seal with the bore of the operating string OS behind the cement or substance represented at 24. When the second or upper plug means 50 sealably engages in the second or upper liner wiper means 45 as illustrated in FIG. 4, they may then be released together from the operating string OS by the pressure therein to form a movable seal in the liner L behind or above the cement. It can be appreciated as the second plug means 50 moves through the operating string to seat in the upper wiper means 45, it will wipe the bore of the operating string OS and in turn it and the upper wiper means form a movable seal to wipe the interior wall of the liner L as they move therethrough.

Figure 5:
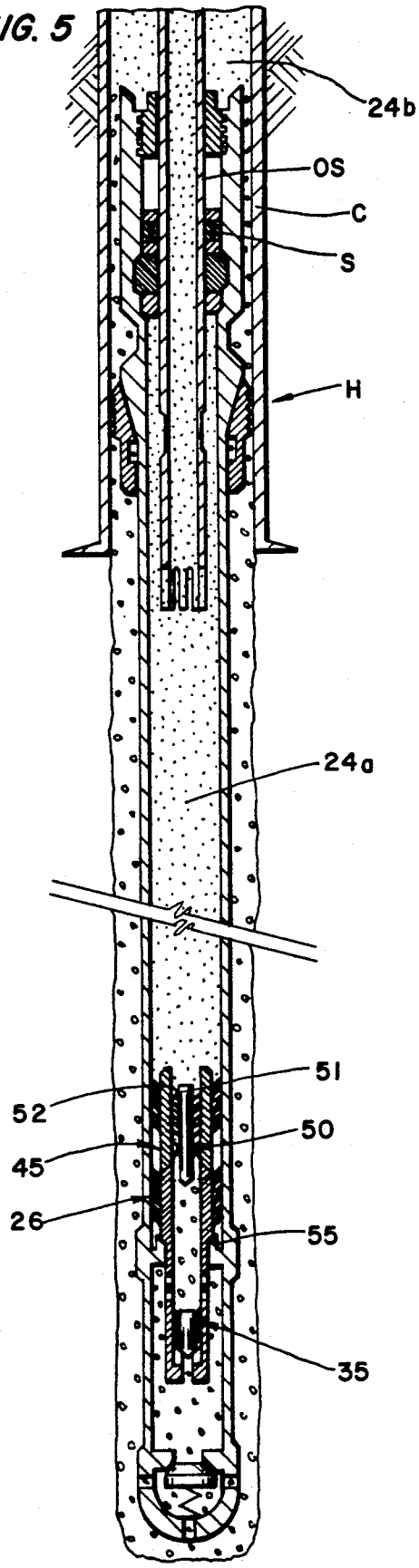

The upper wiper means 45 and engaged second or upper plug means 50 form a movable seal or barrier behind or above the cement or substance represented at 24 to separate it from the fluid represented at 24a in FIGS. 4 and 5 in the operating string OS and liner L behind the engaged second wiper means 45 and plug means 50. In a similar fashion the first plug means 35 and wiper means 26 separate the cement or substance 24 therebehind from the fluid portion 24b in the well bore WB and in the liner below the first plug means 35 and first wiper means 26 as illustrated in FIGS. 1-3.

It will be noted that as the cement, or any substance, is pumped down the operating string OS, any fluid ahead of first plug means 35 in the operating string will be discharged into the well bore annulus WB ahead of the discharge of the cement, or substance. As noted previously, cleaning or other well bore conditioning or spacer fluid may precede the cement, or substance, immediately ahead of the first plug means 35 and the first wiper means 26 when they are engaged and released for movement.

The first plug means 35 and first wiper means 26 may move downwardly and latch with the catcher means 55 before or after release of the second wiper means 45 and the second plug means engaged therewith from the operating string, depending upon the volume of cement, or substance between the spaced movable seals that is to be discharged to the well bore annulus WB.

It will be noted that the liner L is normally provided with a one-way acting valve means represented generally at 40 adjacent its lower end to prevent backflow from the well bore annulus WB. As illustrated schematically in FIG. 3 lock means 60 associated with the first liner wiper means 26 and first plug means 35 has been actuated to release plug means 35 from the first wiper means 26 for communication through the ports P in the extension 27 of the first liner wiper means 26 below catcher means 55 to enable the cement, or substance, behind the first plug means 35 and engaged wiper means 26 to communicate through the liner L and out the back pressure valve 40 into the well bore annulus WB.

As schematically illustrated in FIG. 5 after movement of both the first wiper means 26 and its plug means 35 and second wiper means 45 and its plug means 50 through the liner, the upper plug means 50 sealably engages and latches with both the second wiper means and the first wiper means that has been previously latched and sealed in the catcher means 55. This forms a back-up one-way acting valve to prevent reverse flow from the well bore adjacent the liner L into the liner. Such arrangement also facilitates drilling or milling the first and second wiper means to remove them from the interior of the liner L after the cementing operation is completed.

The positioning means includes hanger means represented generally by the letter H as well as other components that will be described which enables the liner L to be positioned and suspended or hung on the casing C as schematically represented at FIGS. 1-5.

Figure 6:
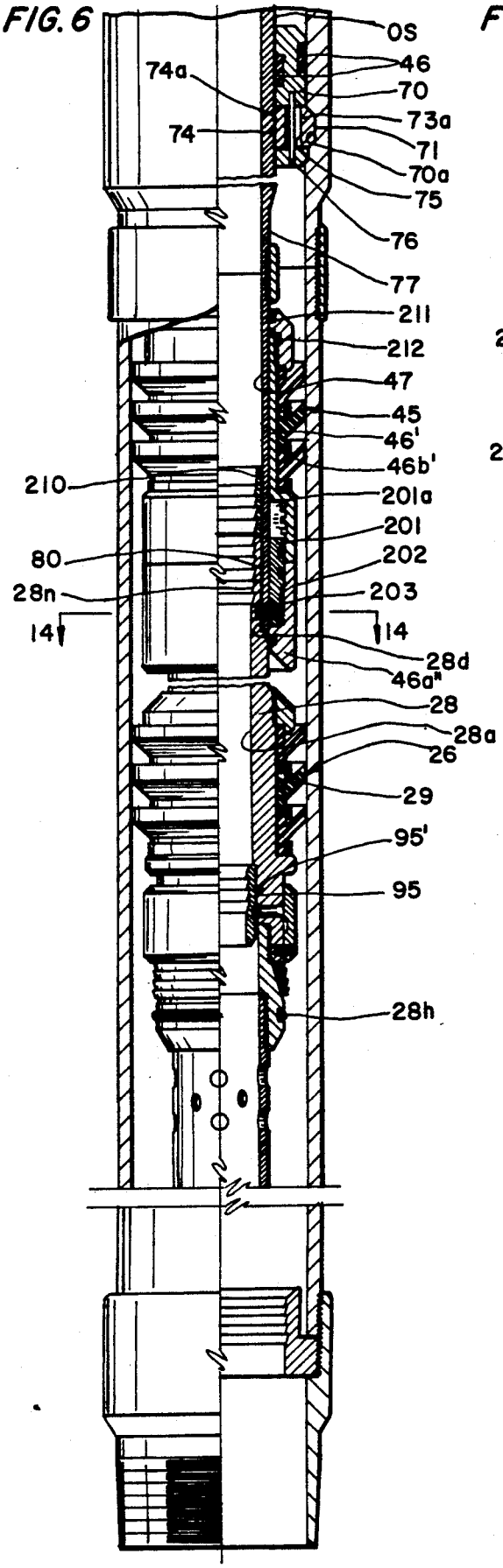
FIG. 6 is a longitudinal sectional view partly in elevation of the upper portion of a tool illustrating a form of the component relationships of the present invention with seal means between the liner and the operating string with which it is secured as well as the seals between the upper wiper means and operating string and between the upper and lower wiper means releasably secured with the operating string to isolate the bore of the operating string from the well bore, or tubular member surrounding the operating string. The lower and upper wiper means are shown as being connected to the operating string by shear means located at substantially the same transverse and circumferential position.

The seal means S may be of the conventional drillable or swab cup type packer form or may assume the retrievable form illustrated in FIG. 6 wherein body means 70 are provided with seal means 46 for engaging the interior of the liner and the exterior of the operating string for sealing therebetween.

Cooperating surface means on the liner L in the form of an annular recess or profile 71, the annular surface 74 on the operating string and the exterior annular surfaces 70a, 74a on the movable members or projecting lugs 73a mounted in circumferentially spaced windows of the body 70 cooperate to engage and lock the body means 70 to the liner L to maintain a seal between the liner L and the operating string OS while accommodating movement of the operating string relative thereto. A pin 76 in enlarged passageway 75 in lugs 73a retain lugs in windows of the body 70 while accommodating lateral movement of the lugs laterally of the body 70.

Means to unlock the cooperating surface means are provided in the form of the smaller annular diameter portion 77 on the operating string which, upon further relative longitudinal movement between the operating string and body means 70 align the small diameter portion 77 on the operating string with the projection or lugs 73a to accommodate their retraction from the recess 71 so that the seal means S may be retrieved from the well bore WB along with the operating string OS.

It will be noted that the operating string OS extends substantially through the bore 47 of the second or upper wiper means 45 and terminates in overlapping relation as represented at 80 in relation to the body 28 of first or lower wiper means 26 as more clearly seen in FIG. 6.

Also, the second or upper wiper means 45 includes a body referred to at 46' on which are disposed a plurality of flared or projecting and longitudinally spaced resilient means 46b' for wiping the interior of the liner or tubular member. The operating string OS extends substantially through the longitudinal bore 47 of the second wiper means 45 as previously stated and enables the first wiper means 26 to be releasably and sealably secured to the operating string OS in a manner to avoid premature release of the second wiper means 45 when the first wiper means 26 is independently first actuated to release from the operating string and then move, along with its engaged plug means 35 through the liner as described heretofore in connection with FIGS. 1-5.

The first or lower liner wiper means 26 also includes a body 28 on which are arranged flared and longitudinally spaced seal means 29 for sealably engaging with the interior of the liner. The wiper means 26 includes a bore 28a therethrough in which seat 95 is provided for receiving the first plug means 35.

Figure 8:
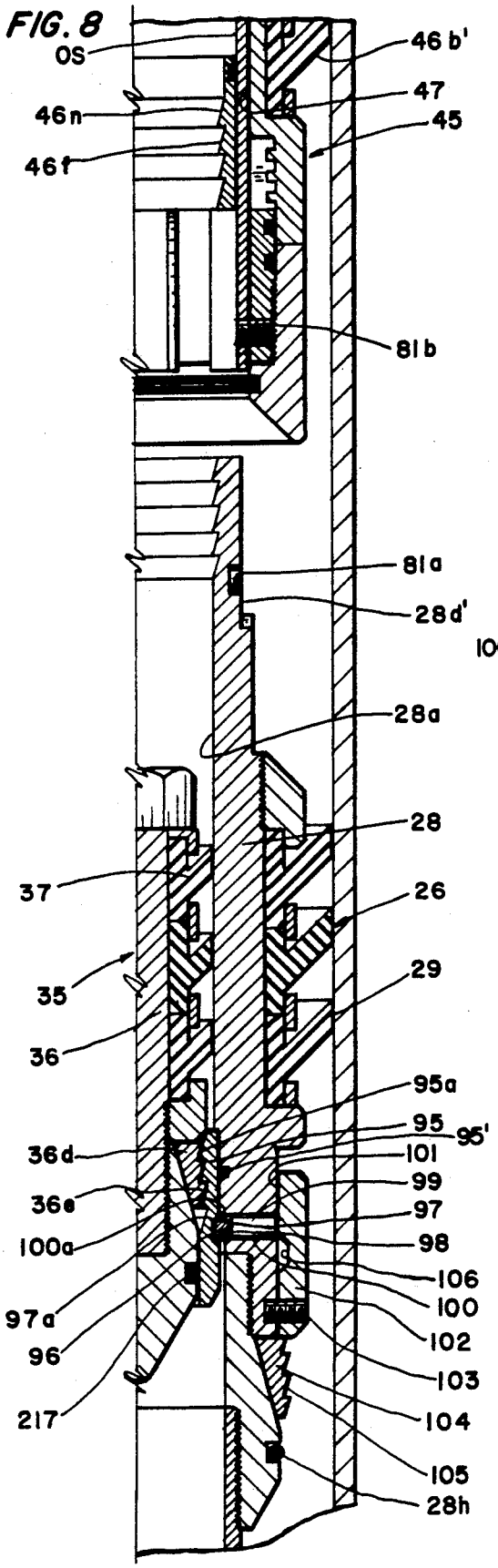
FIG. 8 is a partly enlarged sectional view showing in greater detail the sealing and locking relationship between the first or lower plug means and first or lower liner wiper means and its sealing relationship with the liner, as well as showing the relationship of the first, or lower liner wiper means to the lower end of the second or upper wiper means immediately after the first wiper means is released from the operating string.

The first plug means 35 illustrated in greater detail in FIG. 8 includes a solid body 36 on which are mounted flared or projecting and longitudinally spaced annular seals 37 for initially sealably engaging with and wiping the interior of the operating string as it is pumped therethrough to seat within the first wiper means 26 as shown in FIG. 8 whereupon the seal 217 on the body 36 forms a seal with the bore 28*a* extending through the first wiper means 26.

Figure 11:
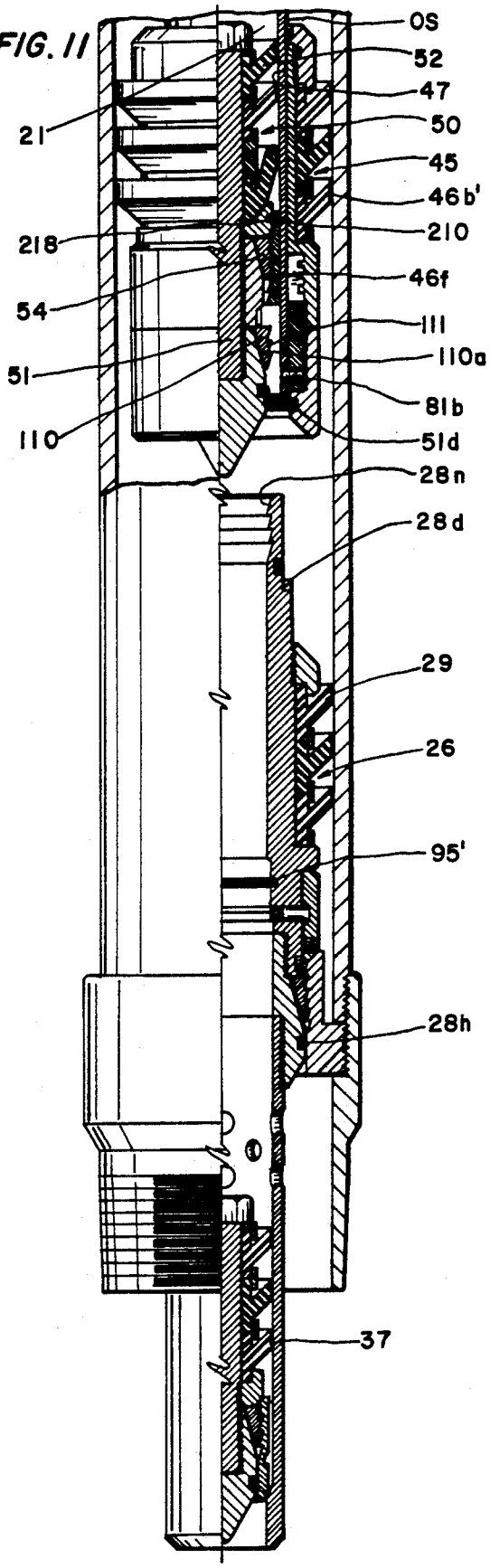
FIG. 11 is an enlarged sectional view partly in elevation illustrating the second plug means in sealing relationship with the operating string and seated, and engaged with the second or upper liner wiper means.

As better seen in FIG. 11, the second or upper pump down plug means 50 also includes a solid body portion 51 on which are mounted flared and longitudinally spaced seal means 52 which initially seal with the operating string OS as it is pumped through the bore thereof and thereafter seals with the portion of the operating string which extends into the bore 47 of the second wiper means 45. As shown in greater detail in FIG. 11 when the plug means 50 is engaged on seat 46*f* forming part of the second wiper means 45 within the bore 21 of the operating string OS seals 210, 218 sealably engage the plug 50 and wiper 45 together.

The outer diameter of the annular seal members 46*b*' and 29, respectively, on the first and second wiper means and the diameter of annular seals 37 and 52, respectively, on the first and second plug means, are of proper diameters for sealing with the bore of the liner or tubular member and the operating string, respectively. Suitable means, shown in FIGS. 8 and 11 of the drawings at 36*d*, 54, respectively, are provided on each the lower and upper plugs 35 and 50 for seating and latching each plug in their respective seat 95 and 46*f* of the lower and upper wiper, respectively.

Figure 15:
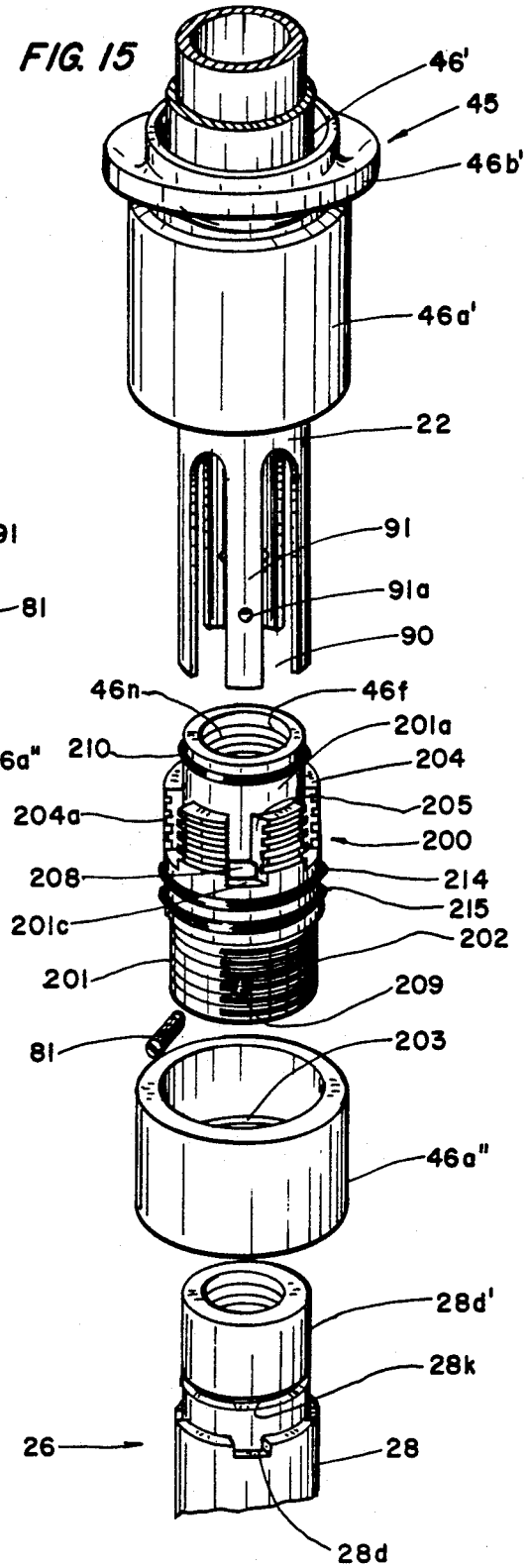
FIG. 15 is an exploded view illustrating in greater detail the relationship of the lower end of the operating string and the upper wiper means as well as the manner of releasably securing the first and second liner wiper means by the releasable shear means embodiment illustrating in FIGS. 1–14 to the operating string.

In FIG. 15 the lower end portion 22 of the operating string is illustrated and has adjacent its end longitudinally extending slots or recesses 90 forming the longitudinally extending, circumferentially spaced projections 91.

The upper end of body 28 of the first or lower wiper means 26 is provided with a longitudinally extending, reduced annular portion 28*d*' on its outer surface as illustrated on the lower end of exploded FIG. 15. As better illustrated in FIGS. 6, 7 and 15 the body 46' of the upper wiper means 45 includes lowermost portion 46*a*' and end cap 46*a*'', which have a larger internal bore than the bore 47 in the part of body 46' above portion 46*a*', except for the annular reduced end portion on 46*a*'' which receives seal 216, as best illustrated in FIGS. 6 and 7. A separate member having a tubular body referred to generally by the number 200 in FIG. 15 in the embodiment illustrated forms part of the upper wiper means.

The body 200 has a longitudinal bore therethrough which has two diameters. The portion 201 of body 200 has external threads 202 thereon for threadedly engaging with internal threads 203 on end cap 46*a*'' of upper wiper means 45. Annularly extending, circumferentially spaced segments or portions 204 with external threads 204*a* on the segments are formed on portion 201*a* of body 200 and provide longitudinal recesses or slots 205 therebetween. The portion 201*a* of body 200 on which the segments 204 are formed, or overlap, is of smaller external diameter than the internal diameter of the bore in portion 201 on which threads 202 are formed, and the bottom of the slots 205 is defined by the shoulder 201*c* on portion 201. Because of the difference in the internal bore diameter in portion 201 and the smaller external diameter of portion 201*a*, the slot 205 terminate in openings 208 in the body at the end of slots 205 which communicate with the overlapped bore of portion 201 of body 200.

The shoulder at the lower end of the reduced external diameter portion 28*b* at upper end of the lower wiper means body 28 is provided with circumferentially spaced notches or recesses 28*d* to receive the ends of fingers of projections 91 to lock the lower wiper means to the operating string to prevent relative rotation therebetween.

The slots 205 in body 200 slidably receive the circumferentially spaced projections 91 on the lower end portion 22 of the operating string OS as more clearly seen in FIGS. 8 and 10–15 inclusive. When the components illustrated in exploded relation of FIG. 15 are assembled as shown in FIG. 6 the smaller diameter portion 201*a* is inserted in the lowermost end of portion 22 of the operating string so that the projections 91 thereof are received within the slots 205 of body 200 and the segments 204 extend through the longitudinal recesses between the fingers 91 and into the bore of the operating string OS. This aligns at least one shear pin opening 91*a* in projection 91 with a corresponding shear pin opening 209 in portion 201 of body 200 as more clearly seen in FIGS. 6, 7, 14 and 15. An annular groove 28*k* or openings may be provided in the reduced portion 28*d*' of the lower wiper body to receive the shear pin 81 to connect the lower wiper body to the operating string. The smaller diameter of portion 201*a* projects or extends within the bore 21 of the operating string and provides the seat 46*f* to receive and secure with the second plug means 50 when it is pumped down the operating string.

Seal 210 is provided on portion 201*a* of upper wiper means 45 to seal within the bore 21 of the operating string. The seal 210 may be positioned in any suitable manner to sealingly engage between the portion 201*a* of body 200 and the bore 21 of the operating string. Suitable seal means 211, 212 are provided to seal between the upper wiper means 45 and the exterior of the operating string and between the end cap and the body 46' of upper wiper 45, respectively. Also seals 214, 215 are provided between body 200 and upper wiper member, and a seal 216 is provided between the upper wiper means 45 and lower wiper means 26 for sealing therebetween when they are assembled on the operating string. A seal 95' is provided between seat 95 and lower wiper body 28 as shown in FIGS. 6–12.

When the first or lower pump down plug 35 is received and sealably seated in the lower wiper means by seal means 217 on the first plug, seals 95', 211, 212, 214, 215, 216 and 217 close off communication between the bore 21 of the operating string and the external seals 29, 52, respectively, on lower and upper wiper means 26, 45, respectively, so that fluid pressure in the operating string is confined to release the first wiper and its plug from the operating string as will be described in greater detail hereinafter without acting on the wiper seals 29, 52. When the second or upper pump down plug is seated in upper wiper means then seal means 218 on the second plug along with seal means 210 close off communication between the bore 21 of the operating string and the external seals 52 so that fluid pressure in the operating string above the upper plug means is confined and acts on the seals 210, 218 to effect the release of the second wiper and its plug from the operating string as will be described in greater detail hereinafter.

In assembly, after the upper wiper 45, and its body 200 are threadedly engaged, fingers 91 of the operating string and slots 205 are aligned and the upper wiper 45 is positioned on the operating string. The smaller diameter portion 201a of the upper wiper means fits within bore 21 of the operating string and then lower wiper 26 can be inserted in the bore of the operating string with end cap 46a'' on top of the lower wiper. In the embodiment shown in FIGS. 6–15, the upper end portion 28d' of the lower wiper is provided with a recess to receive the inner end of shear pin 81.

When assembled, the second wiper means body 46' includes the body 200 and its integral annular portion 46f which receive the projections 91 on operating string OS in the recesses 205 so that portion 46f of the body 46' extends through the operating string and internally of the bore 21 of the operating string OS.

Figure 13:
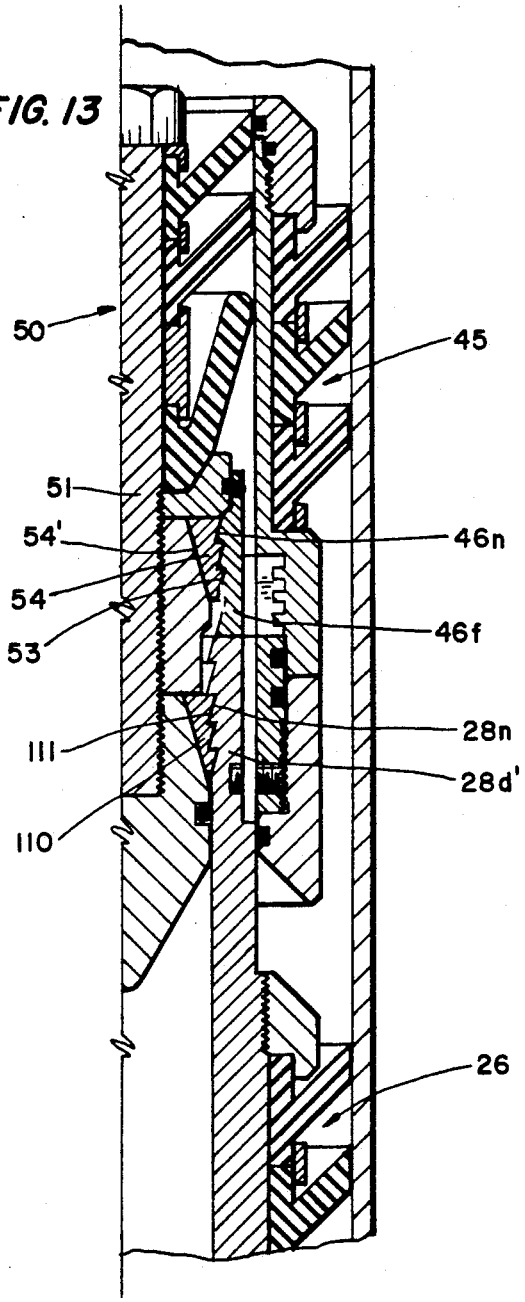
FIG. 13 is an enlarged partial sectional view of the second plug means latched with the second liner wiper means and showing the details for latching the first and second wiper means together.
Figure 14:
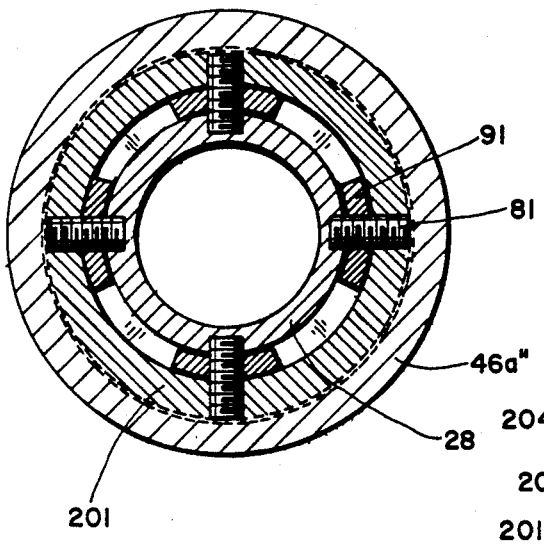
FIG. 14 is a sectional view on the line 14—14 of FIG. 6 illustrating one form of a releasable shear means for releasably securing the first or lower wiper means and second or upper wiper means with the operating string in accordance with the present invention.

As shown in FIGS. 13 and 15, and as noted, a buttress thread arrangement 46n is formed on the internal bore of seat 46f for latching with the buttress threads 53 formed on the outer circumference of the ring 54 on plug means body 51. The ring 54 has a longitudinal groove therethrough to accommodate flexing thereof on its tapered seat 54' on body 51 as such ring moves into latching relationship with seat 46f.

It can be appreciated that the foregoing structural relationship of the operating string OS to the upper or second wiper means 45 and lower or first wiper means 26 is such that the operating string extends substantially through the longitudinal bore 47 of second wiper means 45 and terminates in overlapping relation with the lower wiper means 26 for releasably securing with each of them. Also the portion 201a of the second or upper wiper means 45 provides a portion which extends through the slots 90 of the operating string and into the bore 21 thereof to receive and seat the second plug means 50 for release and movement of said second plug means 50 and second wiper means 45 together through the liner. The internal bore of the portion 46f which is within the operating string OS is configured in any suitable manner to engage and latch with the second plug means 50.

The separate seal or wiping elements provided on each the first and second wiper means and the first and second plug means can be of any suitable form and figuration and as illustrated are a plurality of separate wiper or seal means which are retained on the respective body means of the wiper and plug means by any form of retainer means as illustrated in the drawings.

Figure 9:
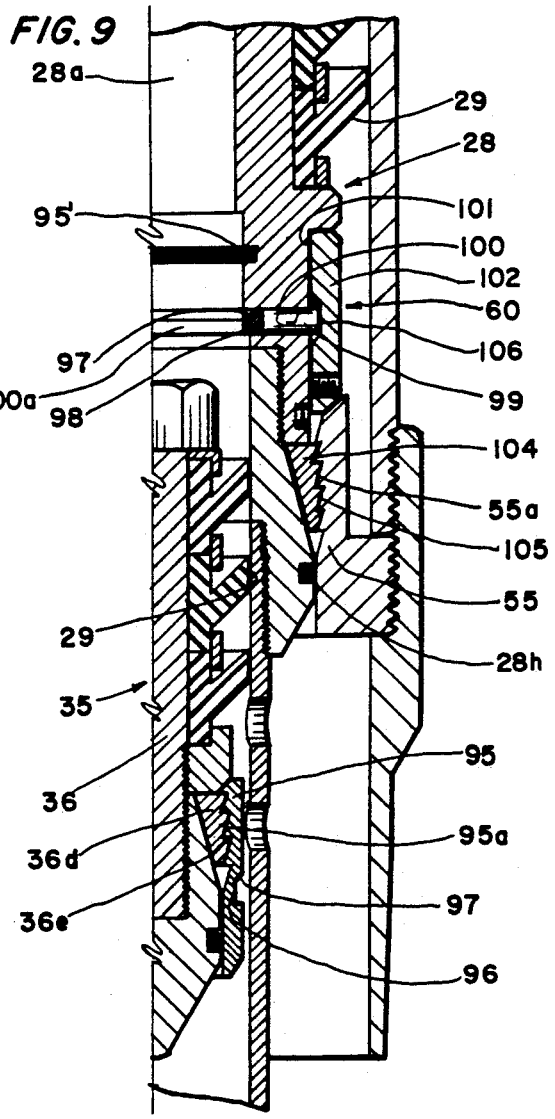
FIG. 9 is an enlarged partial sectional view illustrating in greater detail the catcher means for receiving and latching with the first wiper means with the lock means unlocked and actuated which enables the first plug means to release from the first wiper means for movement longitudinally thereof to accommodate communication from the liner above the first wiper means and plug means to the desired well bore region.

The lock means 60 for the first plug 35 and wiper 26 is shown in enlarged detail in FIGS. 8 and 9. The first or lower wiper means 26 is provided with an annular collar or seat 95 releasably locked in its internal bore 28a by ring 98 in groove 100a. Buttress threads 95a are provided on the internal diameter of the collar 95 for latching with the ring 36d carried on the tapered seat of first plug 35. The ring 36d also is split longitudinally to accommodate flexing and is provided with buttress threads 36e for engaging with the buttress threads 95a of the collar 95 in the first wiper means 26. The seat 95 is provided with an annular groove 96 which has a taper 97 at its upper annular side as shown. The split ring 98 is configured to conform with and be received in the groove 96, and its inner, upper annular edge is tapered at 97a to conform with taper 97 on groove 96. The ring 97 is split to accommodate flexure thereof and retainer pins 99 extend through circumferentially spaced radial opening 100 which terminate in the annular groove 100a of body 28 of the first wiper means. The ring 98 is dimensioned to also partially rest in annular groove 100a to which the inner ends of the openings 100 terminate. The retainer pins inner ends therefore abut the outer circumference of ring 98 and the outer end of the retainer pins 99 abut the inner annular surface 101 of collar 102 when the collar 102 is retained in the position shown in FIG. 8 by the shear pin 103 engaging it and body 28.

From the foregoing it can be seen that after the first plug 35 latches with the first wiper means 26 and the inner end 81a of shear pin 81 sheared as shown in FIG. 8, this enables the first wiper means to release from the operating string OS as shown in FIG. 8. The collar 102 abuts the outer ends of the retainer pins 99 to lock ring 98 in the relationship shown in FIG. 8 and thus secure or lock the first plug means 35 with the first or lower wiper means 26 against premature release as they both move through the liner L ahead of the cement.

Figure 10:
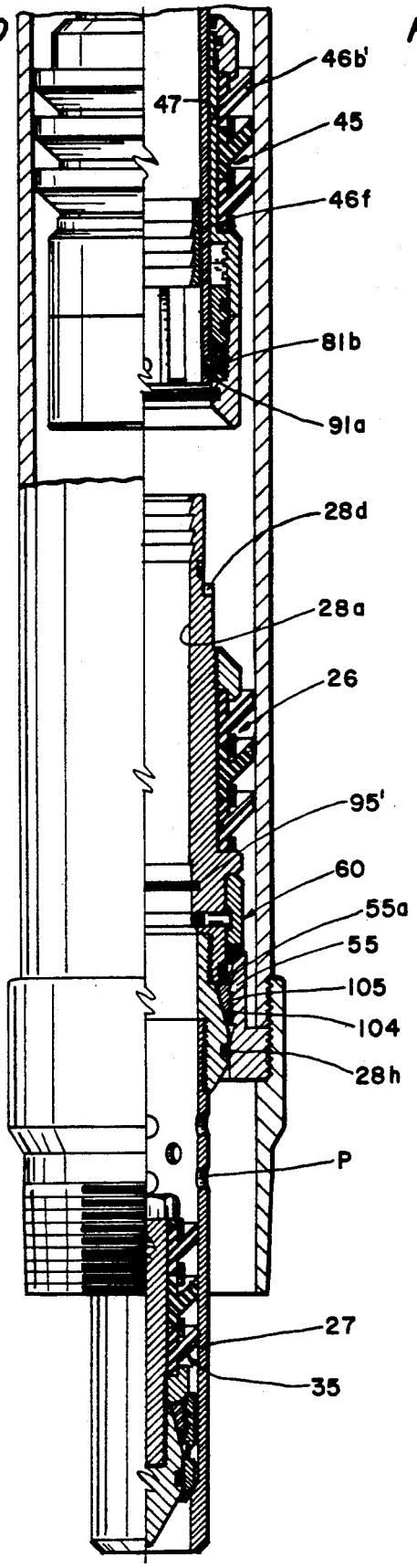
FIG. 10 is an enlarged sectional view partly in elevation demonstrating the position of the first plug means after release from the lower wiper means adjacent the lower end of the lower liner wiper body bore and with communication opened to the liner for discharge of the cement, or substance, from above the first wiper means.

The first plug means 35 and first wiper means 26 will remain locked together as shown in FIG. 8 as they both move through the liner. The lower split ring 104 on the tapered body 28 of the first wiper means 26, as shown in the drawings, FIGS. 9 and 10, is received at the end of the travel within the liner in the catcher means 55 arranged adjacent the lower portion of liner L. The catcher means 55 has buttress threads 55a which engage outwardly facing buttress threads 105 on ring 104 and lock the first plug and wiper means together in catcher 55. The seal 28h in the first wiper body 28 below split ring 104 seals in the smooth bore portion of catcher means 55, as shown in FIGS. 10 and 11. When suitable pressure in the operating string is thereafter applied, the pin 103 is sheared.

When pin 103 shears, the collar 102 on the outer surface of the first wiper means 26 can move longitudinally to align internal groove 106 therein with the outer ends of the openings 100 in which retainer pins 99 extend. The internal pressure in the operating string and liner will force plug means 35 down, and due to the tapers 97, 97a on the upper groove and ring edge, respectively, the seat 95 of lower wiper means 26 is released from engagement with ring 98 and moves down with plug means 35 and expands ring 98 into the groove 100a to force pins 99 radially outward in openings 100 into the annular groove 106 of collar 102. This relationship is shown in FIG. 9. This enables the first plug means 35 to unlock from the first wiper means 26 and move into extension 27 beneath port means P therein to open the liner beneath first wiper means 26 for communicating the liner above the first wiper means to discharge cement from the liner L above the first wiper means 26 to conduct it through one-way valve means 40 to the well bore annulus WB surrounding the liner to initiate cementing the liner in place. The height of the cement in the well bore WB may vary depending on the circumstances.

It can be appreciated that when the first wiper means 26 and its plug means 35 responds to fluid pressure in the operating string to actuate the shear pin 81 only the inner end portion thereof represented at 81a in FIG. 8 shears, leaving the remaining portion 81b intact, as shown in FIG. 8, so that it remains extended through an opening or recess 91a in at least one of the projections 91 of the operating string OS, as well as extending through or into the opening 209 in portion 201 of member 200 which forms part of the second wiper means 45. Thus, the second wiper means 45 remains intact and releasably secured on the operating string OS after the first wiper means has been released therefrom.

When the second plug 50 moves in the bore 21 of the operating string OS and engages and latches with seat 46*f* on the second wiper means, seals 210 and 218 confine pressure in the operating string to shear the portion 81*b* of the shear pin 81 and release the second or upper wiper means 45 and the second plug engaged therewith from the operating string OS. It is to be noted that when the second plug means 50 is engaged in the second wiper means 45 and the wiper means has released from the operating string, the seal means 52 thereon engages within the bore 47 of the second wiper means and seals therewith. The seal means 46*b'* on the wiper means 45 sealingly engage with the interior walls of the liner L and the second plug 50 in bore 47 form a movable seal behind the cement and wipe the cement from the interior wall as they jointly move therethrough along toward the first wiper means 26 latched in the catcher means 55.

Figure 12:
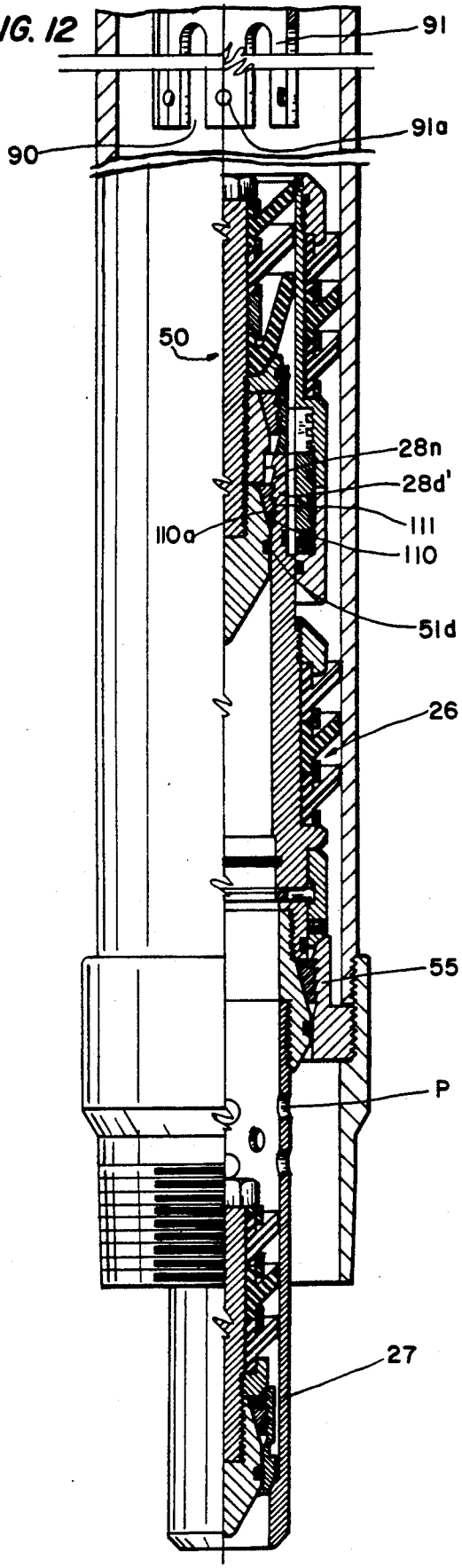
FIG. 12 is an enlarged sectional view partly in elevation illustrating the lower end of the operating string after the second or upper liner wiper means with its plug means in the bore thereof has been released from the operating string and further demonstrating the second or upper liner wiper means and second plug means engaged or latched with the first or lower wiper means in the catcher means to retain them as a unit.

The second plug means 50 is provided with a lower split latch ring 110 which is spaced from the latch ring 54 and its tapered seat as shown in FIG. 11 of the drawings. It is provided with the external buttress threads 111. The portion 28*d'* of the first wiper means 26 is provided with internal buttress threads 28*n* as illustrated in FIGS. 12 and 13 for receiving and latching with the ratchet threads 111 on the latch ring 110 adjacent the lower end of the second plug means 50 as shown in FIG. 12 of the drawings. The ring 110 is also on a tapered annular surface 110*a* of the second plug means as is the ring 54, so that flexing of the split rings is accommodated as they engage with seat 46*f* and threads 28*n* in the bore of 28*a*, respectively. The O-ring 51*d* in the second plug body 51 below split ring 110 seals in bore 28*a* of lower wiper means 26 as shown in FIG. 10. This secures the upper or second plug and wiper means 45 in latched, locked and sealing relation to the lower or first wiper means 26 when it is secured in the catcher means 55. This arrangement provides a safety backpressure valve in addition to the set shoe arrangement illustrated in FIGS. 1–5 of the drawings. Also, it enables the tandem wiper plug arrangement to be kept as a unit for milling to remove them from the liner when desired.

As noted with regard to the embodiment just described the structure enables the first or lower wiper means 26 to be secured to the operating string below the upper or second wiper means 45 which eliminates the disadvantage of having any portion of the first wiper means moving through or past any restriction, or smaller internal diameter of the first wiper means. It also enables the bore 28*a* of the first wiper means 26 to originate adjacent and extend away from the lower end of the second or upper wiper means 45 and since the operating string extends through the upper wiper means 45 and terminates in overlapping relation to the lower wiper means 26, the second plug means 50 forms an initial seal only in the operating string OS and not in the upper or second wiper means 45 when it is engaged therewith while the second wiper means remains secured to the operating string.

While the second or upper wiper means 45 has a portion 46*f* defining a smaller diameter than the diameter of the bore of the operating string or the bore of the second wiper means 45, the first or lower wiper means 26 is secured below the portion which forms the smallest internal diameter present in the bore of the upper or second wiper means. This avoid or reduces the possibility of the first or lower wiper means hanging up in such restricted diameter which might cause possible premature release of the second wiper means 45 during the cementing operations. It is also noted that the releasable means in the form of shear pin 81 which is shown in FIGS. 6–15 as extending through the second or upper wiper means and terminating in overlapping relation with the first or lower wiper means releasably securing them to the operating string OS is at substantially the same transverse position therein.

When the upper or second pump down plug is seated in the upper liner wiper plugs, seals 210 and 218 close off communication between the operating string bore 21 and the well bore or cavity at the connections between the upper and lower wiper means and the operating string. When the first plug 35 is seated in the first wiper 26, it is latched therewith as previously described and the seal 217 on the lower plug sealingly engages in the bore of the first wiper. When it is desired to release the first plug and wiper, pressure in the operating string is increased. The foregoing sealing relationships confine the fluid pressure or at least prevent communication from the operating string to the components or the liner or well bore in a manner that might prevent the release of the plug and wiper from the operating string or adversely affect proper release of the wiper and its plug.

For example, in prior arrangements, the operating string fluid pressure has been permitted to communicate with and act on the lower wiper seals which presents a much larger effective cross-sectional area responsive to the fluid pressure. This may cause the system to malfunction by permitting the lower wiper to release from the operating string OS at a much lower than desired pressure. However, in the present invention the effective cross-sectional area responsive to fluid pressure force to release the lower plug is the inner diameter of seal 216 which diameter is smaller than the outer diameter of seals 29 on the first wiper.

Similarly, when the second or upper plug 50 is seated in upper wiper 45 (after the first plug and wiper have been released from the operating string) the seal 218 on the upper plug along with seal 210 between the upper wiper and operating string bore confines the operating string fluid pressure to the effective area defined by the diameter of the operating string at seal 210.

By confining the fluid pressure that releases the lower and then the upper wiper means from the operating string in a manner by the example of the present invention, release of the wiper means may be better controlled to avoid malfunctions or nonfunctioning of the system.

Also, by locking the upper and lower wiper to the operating string against relative rotation between the operating string and either wiper, premature release thereof is inhibited during rotation of the operating string in the liner.

Figure 16:
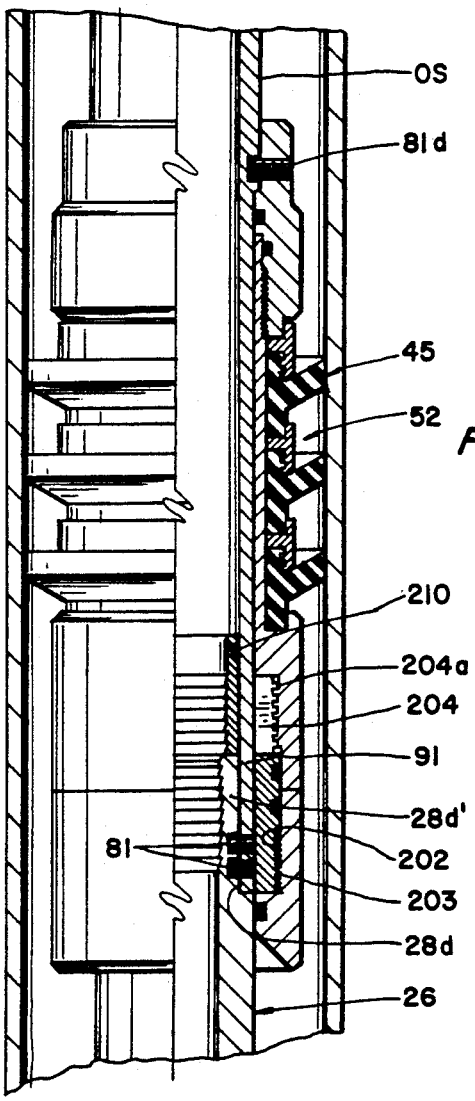
FIGS. 16, 16A and 16B are each sectional views partly in elevation similar to FIG. 6 and illustrating an alternative arrangement of the releasable shear means for the first or lower wiper means and the second or upper wiper means.
Figure 16A:
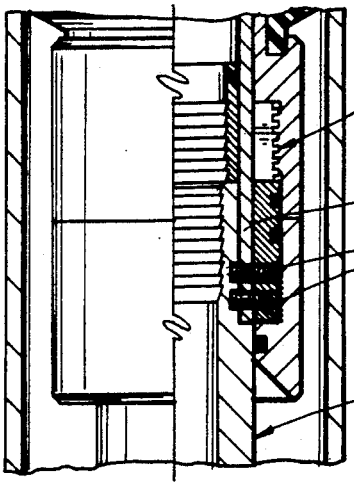
Figure 16B:
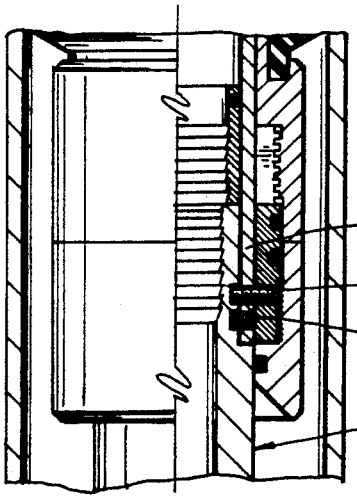

FIGS. 16, 16A and 16B show alternate arrangements of shear pins for releasably securing the upper and lower wiper means to the operating string.

In FIG. 16 a pair of shear pins 81 are shown for extending through the portion 28*d'* of the lower wiper means 26 and into or through at least one of the fingers 91 of the operating string OS to secure the lower wiper means 26 to the operating string. Shear pin 81*d* is provided at the upper end of the upper wiper means 45 for securing the upper wiper means to the operating string. In FIG. 16A a pair of shear pins 81 are provided for extending into or through the upper end portion 28*d* of the lower wiper means 26 and into or through the fingers 91 of the operating string and the body 200 of the upper wiper means for securing them to the operating string. In FIG. 16B a single shear pin 81 is shown as securing the lower wiper means 26 to the operating string and a shear pin 81e is shown as securing both the lower and upper wiper means to the operating string.

Other shear arrangements may be provided to accomplished desired results.

FIGS. 17–20 illustrate further details of the positioning means of the present invention which enable the liner L to be hung or supported on the well bore casing to extend therefrom as schematically represented in FIGS. 1–5 of the drawings. The seal means referred to generally at S is constructed in a manner previously described with regard to FIG. 6.

Figure 18:
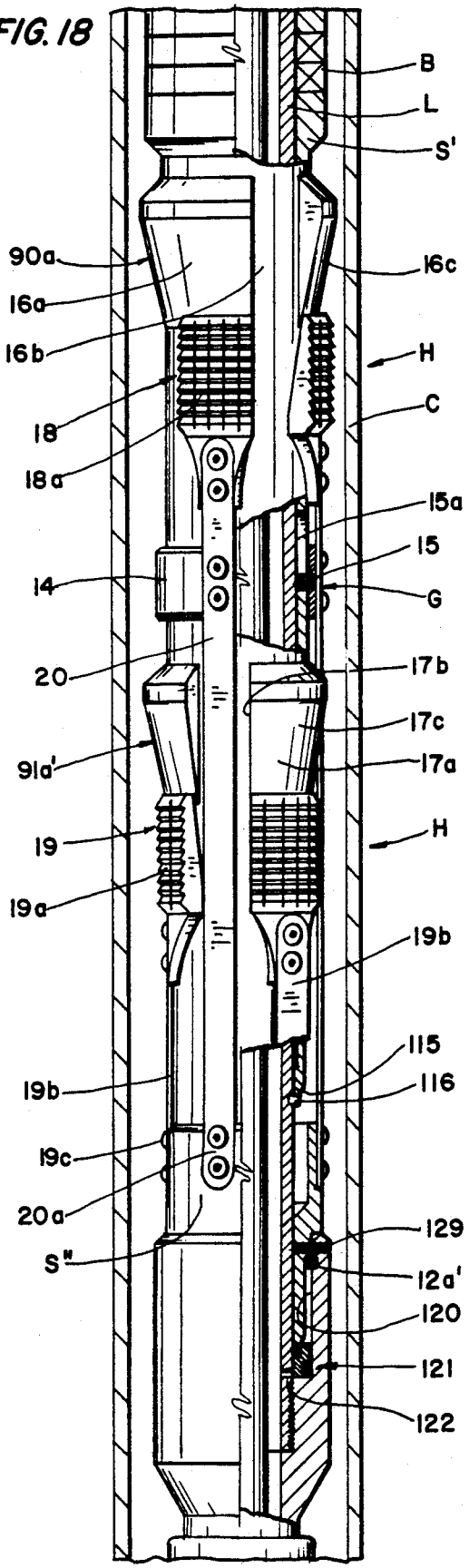
FIG. 18 is a sectional view, partly in elevation, and is a continuation of FIG. 17 showing part of the positioning means for the liner where multiple, longitudinally spaced liner hangers are hydraulically, simultaneously set with bearing means for liner rotation relative to the set hangers.
Figure 20:
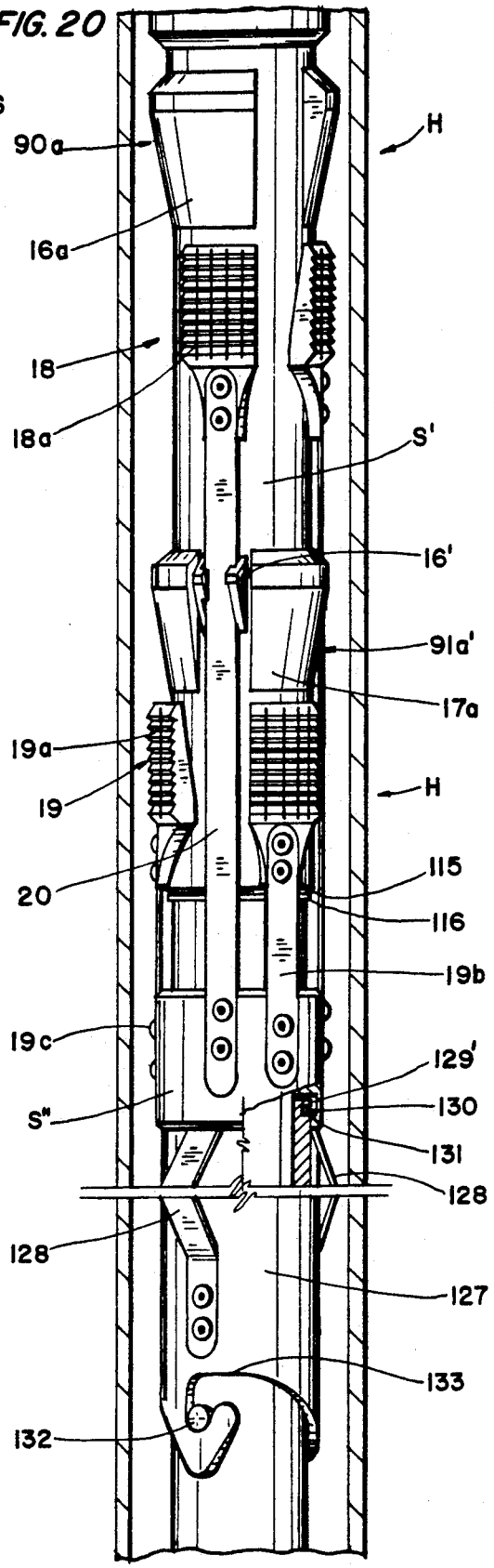
FIG. 20 is similar to FIG. 18 but shows a mechanical arrangement for simultaneously actuating multiple hangers to hang or set the liner on the casing in the well bore for rotating the liner relative to the set hangers.

The hanger means referred to generally at H in FIGS. 18 and 20 are shown in greater detail and in the form illustrated in such view it will be noted that a pair of such hangers are demonstrated. In some circumstances only one hanger H will be employed, while in other arrangements, more than one hanger arrangement H may be employed. Where two or more hanger arrangements are provided, it may be preferable to simultaneously set such hanger arrangements to distribute the load of the liner among the multiple liner hangers and/or reciprocate the liner in the well bore before hanging the liner L on the casing C to aid in conditioning the well bore and/or drilling mud as well as rotating the liner either during cementing operations in the well bore or after it has been hung.

The operating string OS includes an inner member I having a noncircular mandrel portion M connected between the inner member I and the remainder of the operating string so it will perform its function without interfering with other operations. The liner L represented in FIG. 17 has an outer member Q connected therewith which extends upwardly from the liner L as represented in FIG. 17.

Figure 17:
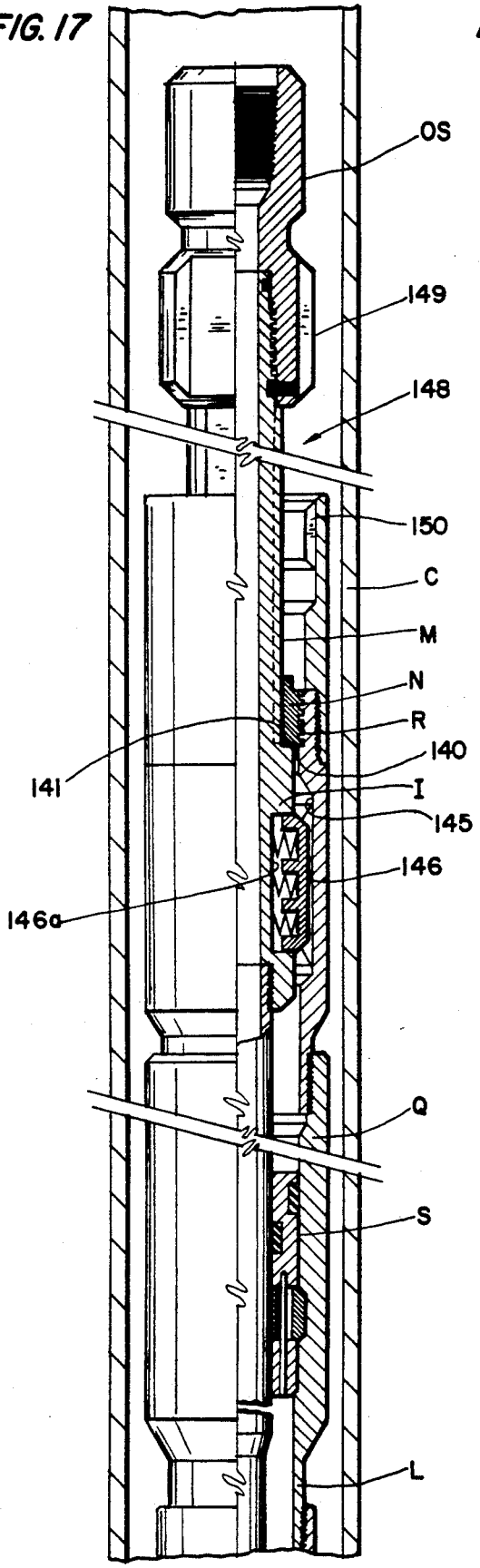
FIG. 17 is a sectional view, partly in elevation, illustrating another arrangement of the upper end of FIG. 6 and illustrating a form for use where it is desired to rotate and/or reciprocate the liner where the plug and wiper means of FIGS. 1–16 are employed in cementing operations.

The inner member I and outer member Q are telescopically arranged as shown in FIGS. 17 and 18 and the hanger means H is supported on the liner L for engagement with the casing C to hang or support the liner L on the well bore casing C. The liner hanger arrangements H are in effect part of the liner L since the outer member Q supports the annular bearing means B and the first sleeve means S'. The first sleeve means S' extends longitudinally about the liner a suitable extent and is supported thereon at its lower end 115 by annular ring 116 on liner L or other suitable means for rotation relative to the liner. The first sleeve means S' is provided with upper and lower spaced annular rows 90a and 91a' conically shaped segments 16a and 17a, respectively. The conically shaped segments 16a in the upper row 90a are circumferentially spaced relative to each other by the spaces 16b therebetween and are offset circumferentially relative to the conically shaped segments 17a in the row 91a' of which segments 17a are spaced circumferentially with spaces 17b therebetween. The conically shaped segments 16a and 17a of each row 90a and 91a', respectively, extend longitudinally of the first sleeve means S' and the segments 16a, 17a are provided with outer tapered surfaces 16c, 17c, respectively.

Spaced annular rows of hanger slips 18 and 19, respectively, are formed by the hanger slip segments 18a, 19a, respectively, with the hanger slips 18a in row 18 being offset circumferentially relative to slip segments 19a in row 19. The slip segments 18a in row 18 and slip segments 19a in row 19 are circumferentially spaced from each other to provide circumferential spaces therebetween so that the hanger slips 18a are longitudinally aligned with the conically shaped segments 16a in row 90a and the hanger slip segments 19a are longitudinally aligned with the segments 17a in row 91a'. Means in the form of elongated strips 20 are connected with the hanger slips 18a in row 90a and extend longitudinally of the first sleeve means S' through the spaces 17b between the conically shaped segments 17a in row 91a' and the strips 20 are connected at their lower ends 20a by any suitable means to the second sleeve means S'' at 19c.

The sleeve means S'' is spaced longitudinally from the lower end 115 of the first sleeve means S' as shown in FIG. 18.

The longitudinally extending strips 20 may be secured to suitable guide means G which includes the collar 14 connected to the strips 20 between the spaced rows 90a and 91a' of conical segments 16a and 17a by any suitable means such as screws or the like as shown in the drawings. The guide means G also includes projection means 15 on collar 20 fitting in the longitudinal slot 15a of the sleeve S' to assist in maintaining the hanger slip segments 18a in the row 18 aligned with the conically shaped segments 16a in the annular row 90a. In FIG. 20 the guide means G of FIG. 18 is shown as being in the form of a bracket 16' positioned on the first sleeve means S' to receive the elongated strips 20 and assist in maintaining the slip segments 18a aligned with the conical segments 16a in row 90a.

The slip segments 19a are connected with elongated strips 19b which are also connected to the second sleeve means S'' by any suitable means such as screws 19c or the like as shown.

In the arrangement shown in FIG. 18 the second sleeve means S'' is received within the annular and longitudinally extending recess or chamber 120 formed in the liner which recess is provided with a suitable piston and seal arrangement referred to generally at 121 adjacent the lower end of the second sleeve means S'' within the chamber. It can be appreciated that, if desired, the hanger arrangement may be structured and positioned so that the upper end of the slidable sleeve can be received within the chamber. The piston and seal means 121 is responsive to fluid pressure conducted from the port means 122 in the liner L to urge the sleeve means S'' upwardly or outwardly of chamber 120 which in turn simultaneously moves the rows of slip segments 18 and 19, respectively, toward and outwardly along the inclined surfaces 16c, 17c of the conical segments in the rows 90a and 91a', respectively, so that the rows of slip segments simultaneously engage and secure the liner L with the surrounding casing C. The split ring 12a' in the groove in sleeve S' prevents the piston and seal arrangement 121 from being pumped out of the chamber 120.

Figure 19:
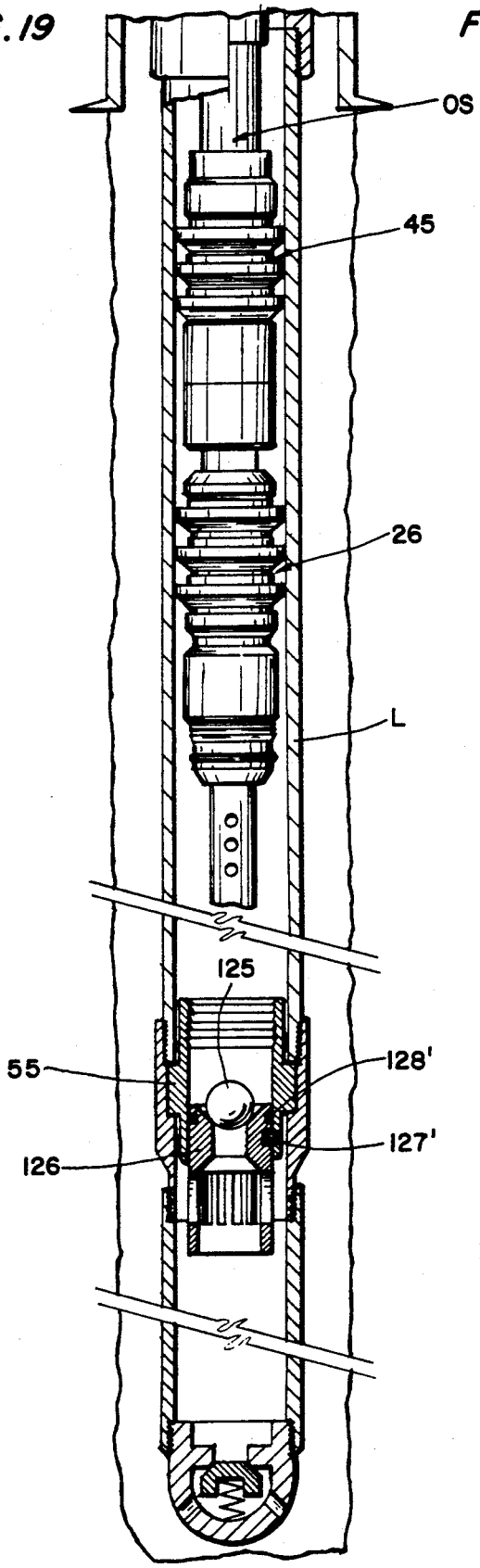
FIG. 19 is a sectional view partly in elevation and is a continuation of the lower end of FIG. 18 and illustrates the catcher means in the liner as well as means to restrict the flow for actuation of the hanger means hydraulically along with bearing means to accommodate rotation of the liner.

It can be appreciated that before actuating the hanger means H hydraulically as described, suitable means to force fluid from the operating string to chamber 120 is employed. As shown in FIG. 19, a ball 125 can be pumped down the operating string to seat on the releasable seat 126 which is releasably secured to the lower end of the catcher means 55 by the shear pin 127'. A suitable seal 128' is provided between the seat 126 and the catcher means 55 and when the ball 125 is seated on the seat 126, fluid pressure may be increased inside the operating string OS and the liner L to move through port 122 into chamber 120 and actuate the second sleeve means as above described so that it moves longitudinally relative to sleeve S' and engage slip segments 18a, 19a simultaneously on segments 16a, 17a and thereby suspend the liner L on the casing C.

After the liner is hung, an increase in pressure in the operating string may be employed to shear pin 127' so seat 126 and the ball will move into liner L beneath the catcher. The seat is constructed so as not to interfere with flow of cement through the liner L and out one-way valve 40 as previously described.

The sleeve means S' is supported on the projection or ring 116 at its lower end 115. The guide means G engage the strips 20 which are in turn secured to the second sleeve S". The second sleeve S" is in turn supported in the chamber 120 formed in the liner L. To prevent premature actuation of the hanger means H the second sleeve means S" is secured to the liner L in chamber 120 by shear pin 129 which shears upon a predetermined pressure from the operating string through port 122 in the liner L to the chamber 120 to shear for relative longitudinal movement between the sleeve means S' and S" for simultaneously setting the hangers with the casing C as previously described. The annular chamber 120, seal arrangement 121 and shear means 129 thus form releasable means for releasably securing said second sleeve means S" to the liner.

FIG. 20 illustrates a hanger arrangement where the hanger means H may be mechanically set. If the mechanical set arrangement is employed, then the hydraulic form of FIG. 17 is eliminated and the structure shown in FIG. 20 would be substituted therefor. While the bearing means B is not shown in FIG. 20, it would assume the same relative position in FIG. 20 as is shown in FIG. 18. It can be appreciated that either the hydraulic set hanger arrangement of FIG. 18 may be employed between the apparatus shown in FIGS. 17 and 19, or a mechanical arrangement as shown in FIG. 20 may be used between the apparatus shown in FIGS. 17 and 19. FIG. 19 is an elevational view showing the upper and lower wiper means forming part of the cementing apparatus shown in detail in FIGS. 1-16 on the operating string. The cementing apparatus illustrated generally in FIGS. 1-16 may be used with the apparatus of FIGS. 17, 18 and 19, or that shown in FIGS. 17, 19 and 20 to accomplish the overall results of the methods of the present invention.

The sleeve means S' in FIG. 20 is rotatably supported on liner L for rotation relative thereto by bearing means similar to that shown in FIG. 18. The sleeve S' is supported at its lower end 115 by an annular ring 116 as described with regard to FIG. 18. The mechanical form also includes longitudinally spaced rows 90a, 91a' of conical segments 16a, 17a, both of which are mounted on the first sleeve means S'. Although two rows are shown, additional rows of segments may be employed if desired as well as a similar number of multiple rows of slip segments. The longitudinally spaced rows 18 and 19 of slip segments 18a, 19a are similar to those previously described. The strips 20 and 19b are secured, respectively, at one end to the slip segments 18a, 19a in rows 18, 19 of slip segments, and at their other end to sleeve means S' as shown in the drawings. The sleeve means S" is spaced longitudinally relative to sleeve means S'. The second sleeve means S" includes an extension 127 on which are mounted the circumferentially, longitudinally extending bow spring means 128. The second sleeve means S" is rotatably supported relative to the extension 127 by means of the overhanging shoulder 129' resting on the ring 130 supported on the ledge 131 of second sleeve S". When rotation is imparted to the operating string OS before the release R is actuated, rotation of the liner hanger arrangement H is restrained by the bow springs 128 so that 127 tends to remain stationary while the liner rotates to thereby disengage pin 132 from the J-slot arrangement 133 adjacent the lower end of extension 127 forming part of second sleeve means S". The J-slot 133 and pin 132 form a releasable connection between the second sleeve S" and liner L in the FIG. 20 form. The J-slots 133 may be configured to release from pin 132 by right-hand or left-hand rotation of the operating strings. Also, the circumferentially spaced bow springs 128 restrain longitudinal movement between the liner hanger arrangements H and the operating string OS and liner L relative to 127 so that subsequent lowering of the operating string OS and liner L relative to 127 after disconnection therebetween effects relative longitudinal movement between the second sleeve means S" and sleeve means S' to urge the row 18 of slip segments 18a and row 19 of slip segments 19a on to their respectively conically shaped segment rows 90a and 90a' for securing the liner to the casing C.

The bore of the nut N of release means R is non-circular as is the adjacent portion of the mandrel M so that rotation of the operating string backs the nut N out of the threads on the outer member Q. The threads in nut N may be right-hand or left-hand, but ordinarily left-hand threads may be used so that when the operating string OS is rotated to the right, the nut N will back out of its connection with the outer member Q. As noted previously, it may be desirable in some instances to rotate and/or reciprocate the liner L in the well bore to condition the well bore before the cementing operation, previously described, is begun. Also, it may be desirable to rotate the liner L during cementing operations. The shoulder means 140 on the nut N engages abutting shoulder means 141 on the inner member I enable the liner to be reciprocated in the well bore by raising and lowering the operating string OS when it is assembled as shown in FIG. 17 and before the liner is hung on the casing C.

Where it is desired to rotate the liner L before supporting it on the casing C, longitudinal, circumferentially spaced slot means 145 within the outer member Q are engaged as shown in FIG. 17 with spring biased longitudinal, circumferentially spaced key means 146 positioned in slots 146a on the inner member I whereby the liner may be rotated by rotating the operating string.

In normal cementing operations, the rotating string is manipulated to disengage the nut N before cementing operations are started so that the operating string connected with inner member I may be retrieved from outer member Q and the liner L in the well bore in the event of some malfunction during the cementing operation. This avoids cementing the entire operating string OS in the well bore. This is accomplished by longitudinally moving the operating string OS to disengage keys 146 from slots 147 and then rotating the operating string OS after the liner L has been hung on the casing C to disengage the nut N from between the operating string and outer member Q as above described. An arrangement is provided for rotating the liner in the well bore during cementing operations or after cementing the well bore during cementing operations or after cementing operations have been completed by the plug and wiper means of the present invention.

The operating string OS has been previously disengaged from outer member Q as above described and the outer member Q is now supported on the casing C along with the liner L so that the operating string OS may be lowered relative to outer member Q. When operating string OS is lowered keys 146 disengage from slots 145 and the lowering of the operating string OS is continued until the additional means referred to generally at 148 on the operating string OS and outer member Q are interconnected so that rotation may be imparted to the liner. The additional means 148 in the FIG. 17 form is shown as consisting of longitudinally extending, circumferentially spaced rigid projections 149 to provide longitudinally extending recesses therebetween so that the projections and recesses may be interfitted with the circumferentially spaced projections 150 adjacent the upper end of the outer member Q for imparting rotation to the outer member Q and to the liner L supported by means of the bearing B.

Another form of the additional means 148 may be employed which would merely consist of additional slot means in the outer member Q longitudinally spaced downwardly from and similar to the slot means 145 so that upon further lowering of the operating string, after keys 146 have disengaged from the upper slots 145, keys 146 on the operating string as shown in FIG. 17 thereon could be disengaged in the lower, slot means (now shown) spaced from slot means 145 to effect rotation of the liner. It can be appreciated where the additional means is in the form of a second key or slot arrangement on the outer member longitudinally spaced from the first key 146 and slot means 145 shown in FIG. 17, the rigid projection arrangement 149 and splines 150 on the outer member would be eliminated. When the operating string has been lowered to disengage slots 145 and keys 146, further lowering thereof engages the spring loaded, circumferentially spaced keys (not shown) in the second circumferentially slots (not shown) so that rotation may then be imparted to the operating string.

From the foregoing description it can be seen that the present invention provides an arrangement to release the first or lower wiper means from the operating string in a manner to inhibit premature release of the second or upper wiper means. Also, the present invention contemplates an arrangement which enables the liner to be positioned in the well bore by either hydraulic or mechanically actuated hanger means as well as reciprocating and rotating the liner selectively, as desired.

While the location of the portion **46*f* of the second wiper means 45 that extends into the bore 21 of the operating string is shown as being substantially adjacent the lower end of the second wiper means 45, it can be appreciated that it may be located at a higher elevation in the bore 21**.

While only one shear pin 81 is shown in the FIGS. 6–15 embodiment and any other desired shear pin arrangements, some of which are shown in FIGS. 16–16B, may be employed.

In the FIGS. 6–15 embodiment, when the same size pin 81 is employed at the same circumferential and longitudinal positions, both the lower wiper means 26 and upper wiper means 45 will release, or the pins 18 will shear, at the same load but at a different pressure in the operating string due to the effective seal area responsive to pressure on the engaged first plug and wiper means and engaged second plug and wiper means, respectively.

Thus, if it is desired to release both wiper means 26 and 45 at the same pressure, then additional shear pins which extend only between the wiper means 26 and operating string OS are required. Such additional shear pins are circumferentially spaced relative to, and in the same transverse plane, relative to the longitudinal axis of the operating string, as the pins 81 which extend through both wiper means 26 and 45 and the operating string.

If it is desired to release the lower wiper means 26 and upper wiper means 45 at different loads, then the shear pins which support the lower and upper wiper means 26 and 45, respectively, may be provided to accomplish the desired results.

Where the liner is to be set on the well bore bottom, no hanger will be employed.

The present invention has been described in detail in connection with its use in cementing a liner in a well bore; however, it may be employed in any situation where it is desired to isolate a fluid in a well bore, cavity, tubular member or the like, even with varying internal diameters in the tubular member or adjacent tubular members.

The foregoing disclosure and description of the invention are illustrative and explanatory thereof, and various changes in size, shape and materials as well as in the details of the illustrated construction may be made without departing from the spirit of the invention.

What is claimed is:

1. Apparatus for forming a closed system with the bore of an operating string for first releasing sealably engaged lower plug and wiper means and then releasing sealably engaged upper plug and wiper means from the operating string to position a substance in a well bore comprising:

lower and upper spaced plug means for wiping the operating string bore ahead of and behind, respectively, the substance;

lower and upper spaced wiper means for wiping the liner ahead of and behind, respectively, the substance upon sealing engagement, respectively, with said lower and upper plug means for movement through the liner;

shear means connecting said lower and upper wiper means to the operating string; and seals to close off communication between the operating string bore and the well bore when said lower plug means is sealingly engaged in said lower wiper means whereby pressure in the operating string is effective to actuate said shear means and release said engaged lower plug and wiper means from the operating string and to close off communication between the operating string bore and the well bore when said upper plug means is sealingly engaged in said upper wiper means whereby pressure in the operating string is effective to actuate said shear means and release said engaged upper plug and wiper means from the operating string.

2. Apparatus for forming a closed system with the bore of an operating string for first releasing sealably engaged lower plug and wiper means and then releasing sealably engaged upper plug and wiper means from the operating string to position a substance in a well bore comprising:

lower and upper spaced plug means for wiping the operating string bore ahead of and behind, respectively, the substance;

lower and upper spaced wiper means for wiping ahead of and behind, respectively, the substance upon sealing engagement, respectively, with said lower and upper plug means;

shear means connecting said lower and upper wiper means to the operating string which operating string extends through the longitudinal bore of said upper wiper means to terminate, respectively, adjacent the lower and upper ends of said upper and lower wiper means and in overlapping relation with said lower wiper means;

seals to close off communication between the operating string bore and the well bore when said lower plug means is sealingly engaged in said lower wiper means whereby pressure in the operating string is effective to actuate said shear means and release said engaged lower plug and wiper means from the operating string; and additional seals to close off communication between the operating string bore and the well bore when said upper plug means is sealingly engaged in said upper wiper means whereby pressure in the operating string is effective to actuate said shear means and release said engaged upper plug and wiper means from the operating string.

3. Apparatus for forming a closed system with the bore of an operating string for first releasing sealably engaged lower plug and wiper means and then releasing sealably engaged upper plug and wiper means from the operating string to position a substance in a well bore comprising:

lower and upper spaced plug means for wiping the operating string ahead of and behind, respectively, the substance;

lower and upper spaced wiper means each with a longitudinal bore therein for sealably receiving, respectively, said lower and upper spaced plug means for wiping ahead of and behind, respectively, the substance upon sealing engagement, respectively, with said lower and upper plug means;

said upper wiper means surrounding the lower end of the operating string and extending through and into the bore of the operating string;

shear means connecting said lower wiper means within said upper wiper means, said means also securing said upper and lower wiper means within the bore of the operating string below the smallest internal diameter of the bore of said upper wiper means;

seals to close off communication between the operating string bore and the well bore when said lower plug means is sealingly engaged in said lower wiper means whereby pressure in the operating string is effective to actuate said shear means and release said engaged lower plug and wiper means from the operating string; and additional seals to close off communication between the operating string bore and the well bore when said upper plug means is sealingly engaged in said upper wiper means whereby pressure in the operating string is effective to actuate said shear means and release said engaged upper plug and wiper means from the operating string.

4. Apparatus for forming a closed system with the bore of an operating string for first releasing sealably engaged lower plug and wiper means and then releasing sealably engaged upper plug and wiper means from the operating string to position a substance in a well bore comprising:

lower and upper spaced plug means for wiping the operating string bore ahead of and behind, respectively, the substance;

lower and upper spaced wiper means for wiping ahead of and behind, respectively, the substance upon sealing engagement, respectively with said lower and upper plug means;

said upper wiper means having circumferentially spaced openings to receive the operating string longitudinally therethrough;

shear means connecting said lower wiper means to the operating string which extends through the circumferential openings into said upper wiper means;

seals to close off communication between the operating string bore and the well bore when said lower plug means is engaged in said lower wiper means whereby pressure in the operating string is effective to actuate said shear means and release said engaged lower plug and wiper means from the operating string; and additional seals to close off communication between the operating string bore and the well bore when said upper plug means is engaged in said upper wiper means whereby pressure in the operating string is effective to actuate said shear means and release said engaged upper plug and wiper means from the operating string.

5. Apparatus for forming a closed system with the bore of an operating string for first releasing sealably engaged lower plug and wiper means and then releasing sealably engaged upper plug and wiper means from the operating string to position a substance in a well bore comprising:

lower and upper spaced plug means for wiping the operating string ahead of and behind, respectively, the substance;

lower and upper spaced wiper means for wiping ahead of and behind, respectively, the substance upon sealing engagement, respectively, with said lower and upper plug means;

said upper wiper means having circumferentially spaced openings to receive the operating string longitudinally therethrough;

shear means connecting each said lower and upper wiper means to the operating string below the smallest internal diameter of said upper wiper means;

seals to close off communication between the operating string bore and the well bore when said lower plug means is engaged in said lower wiper means whereby pressure in the operating string is effective to actuate said shear means and release said engaged lower plug and wiper means from the operating string; and additional seals to close off communication between the operating string bore and the well bore when said upper plug means is engaged in said upper wiper means whereby pressure in the operating string is effective to actuate said shear means and release said engaged upper plug and wiper means from the operating string.

6. Apparatus for forming a closed system with the bore of an operating string for first releasing sealably engaged lower plug and wiper means and then releasing sealably engaged upper plug and wiper means from the operating string to position a substance in a well bore comprising:

lower and upper spaced plug means for wiping the operating string bore ahead of and behind, respectively, the substance;

lower and upper wiper means for wiping ahead of and behind, respectively, the substance upon engagement, respectively, with said lower and upper plug means;

said upper wiper means having a portion extending through the operating string and into the bore thereof to receive said upper plug means for movement of said upper wiper and plug means together through the liner; and shear means connecting said lower and upper wiper means to the operating string;

seals to close off communication between the operating string bore and the well bore when said lower plug means is engaged in said lower wiper means whereby pressure in the operating string is effective to actuate said shear means and release said engaged lower plug and wiper means from the operating string; and additional seals to close off communication between the operating string bore and the well bore when said upper plug means is engaged in said upper wiper means whereby pressure in the operating string is effective to actuate said shear means and release said engaged upper plug and wiper means from the operating string.

7. Apparatus for forming a closed system with the bore of an operating string for first releasing sealably engaged first plug and wiper means and then releasing sealably engaged second plug and wiper means from the operating string to position a substance in a well bore comprising:

first and second spaced plug means for wiping the operating string bore ahead of and behind, respectively, the substance;

first and second wiper means, each having a longitudinal bore therein for sealably receiving, respectively, said first and second spaced plug means therein for wiping ahead of and behind, respectively, the substance upon sealing engagement, respectively, with said first and second spaced plug means;

said second wiper means having circumferentially spaced openings through which the operating string extends longitudinally;

shear means connecting said first wiper means adjacent the operating string which extends through the circumferential openings and adjacent the lower end of said second wiper means so that the longitudinal bore of said first wiper means originates and extends away from adjacent said lower end of the operating string and said second wiper means;

seals to close off communication between the operating string bore and the well bore when said first plug means is engaged in said first wiper means whereby pressure in the operating string is effective to actuate said shear means and release said engaged first plug and wiper means from the operating string; and additional seals to close off communication between the operating string bore and the well bore when said second plug means is engaged in said second wiper means whereby pressure in the operating string is effective to actuate said shear means and release said engaged second plug and wiper means from the operating string.

8. Apparatus for forming a closed system with the bore of an operating string for first releasing sealably engaged first plug and wiper means and then releasing sealably engaged second plug and wiper means from the operating string to cement a liner in a well bore casing comprising:

first and second spaced plug means for wiping the operating string bore ahead of and behind, respectively, the cement;

first and second wiper means, each having a longitudinal bore therein for sealably receiving, respectively, said first and second spaced plug means therein for wiping the liner ahead of and behind, respectively, the cement upon sealing engagement, respectively, with said first and second spaced plug means for movement through the liner;

said second wiper means having a portion extending through the operating string and into the bore thereof to receive said second plug means for movement of said second plug and wiper means together;

said second wiper means having circumferentially spaced openings through which the operating string extends longitudinally;

shear means connecting said first wiper means adjacent the operating string which extends through the circumferential openings;

seals to close off communication between the operating string bore and the well bore when said first plug means is engaged in said first wiper means whereby pressure in the operating string is effective to actuate said shear means and release said engaged first plug and wiper means from the operating string; and additional seals to close off communication between the operating string bore and the well bore when said second plug means is engaged in said second wiper means whereby pressure in the operating string is effective to actuate said shear means and release said engaged second plug and wiper means from the operating string.

9. The apparatus of claim 7 or 8 wherein said means which releasably secures said first and second wiper means to the operating string is located in substantially the same circumferential position and at substantially the same transverse position with respect to the operating string.

10. The apparatus of claim 7, or 8 wherein said first wiper means and operating string are secured together against relative rotation.

11. The apparatus of claim 7, or 8 wherein the operating string includes a plurality of circumferentially spaced fingers and wherein said first wiper means includes recesses to receive said fingers to secure the operating string and said first wiper means against relative rotation.

12. Apparatus for conducting a substance through the bore of an operating string into a well bore wherein lower and upper wiper means are connected by shear means to the operating string for sealably receiving lower and upper plug means, respectively, for wiping ahead of and behind, respectively, the substance, said apparatus comprising:

a seal between the upper wiper means and the bore of the operating string;

a seal arrangement to close off communication between the operating string adjacent the lower and upper wiper means and the well bore; and shear means on the operating string for releasably securing each the lower and upper wiper means on the operating string.

13. Apparatus for conducting a substance through the bore of an operating string into a well bore comprising:

lower and upper spaced plug means for wiping the operating string bore ahead of and behind, respectively, the substance;

lower and upper spaced wiper means for wiping the liner ahead of and behind, respectively, the substance upon sealing engagement, respectively with said lower and upper plug means;

said upper wiper means having circumferentially spaced openings to receive the operating string longitudinally therethrough;

at least one seal between said upper wiper means and the bore of the operating string;

a seal arrangement to close off communication between the operating string adjacent the lower and upper wiper means and the well bore; and shear means connecting said lower wiper means to the operating string within said upper wiper means and for releasably securing said upper wiper means to the operating string.

14. Apparatus for conducting a substance through the bore of an operating string into a well bore wherein lower and upper wiper means are supported on the operating string and sealably receive lower and upper plug means for wiping ahead of and behind the substance, said apparatus comprising:

at least one seal between the upper wiper means and the bore of the operating string;

at least one seal to close off communication between the operating string adjacent the lower and upper wiper means and the well bore; and first shear means on the operating string connecting the lower wiper means to the operating string; and additional shear means on the operating string in longitudinal spaced relation to said first shear means and connecting the upper wiper means to the operating string.

15. Apparatus for conducting a substance through the bore of an operating string into a well bore comprising:

lower and upper spaced plug means for wiping the operating string bore ahead of and behind, respectively, the substance;

lower and upper spaced wiper means for wiping the liner ahead of and behind, respectively, the substance upon sealing engagement, respectively with said lower and upper plug means;

said upper wiper means having a portion extending through the operating string and into the bore thereof to receive said upper plug means for movement of said upper wiper and plug means together;

at least one seal between said upper wiper means and the bore of the operating string;

at least one seal to close off communication between the operating string adjacent the lower and upper wiper means and the well bore; and shear means connecting each said lower and upper wiper means to the operating string.

16. Apparatus for conducting a substance through the bore of an operating string into a well bore comprising:

lower and upper spaced plug means for wiping the operating string bore ahead of and behind, respectively, the substance;

lower and upper spaced wiper means for wiping the liner ahead of and behind, respectively, the substance upon sealing engagement, respectively with said lower and upper plug means for movement through the liner;

at least one seal between said upper wiper means and the bore of the operating string;

seal means to close off communication between the operating string adjacent the lower and upper wiper means and the well bore; and shear means connecting each said lower and upper wiper means to the operating string.

17. Apparatus for forming a closed system with the bore of an operating string for first releasing engaged lower plug and wiper means and then releasing upper plug and wiper means from the operating string to position a substance in a well bore comprising:

lower and upper spaced plug means for wiping the operating string bore ahead of and behind, respectively, the substance;

lower and upper spaced wiper means for wiping ahead of and behind, respectively, the substance upon sealing engagement, respectively, with said lower and upper plug means;

a seal between said upper wiper means and the bore of the operating string;

a seal arrangement to close off communication between the operating string adjacent the lower and upper wiper means and the well bore; and shear means connecting each said lower and upper wiper means to the operating string.

18. Apparatus for forming a closed system with the bore of an operating string for first releasing engaged lower plug and wiper means and then releasing upper plug and wiper means from the operating string to position a substance in a well bore comprising:

lower and upper spaced plug means for wiping the operating string ahead of and behind, respectively, the substance;

lower and upper spaced wiper means each with a longitudinal bore therein for sealably receiving, respectively, said lower and upper spaced plug means for wiping ahead of and behind, respectively, the substance upon sealing engagement, respectively, with said lower and upper plug means;

said upper wiper means surrounding the lower end of the operating string and extending through and into the bore of the operating string;

shear means connecting said lower wiper shear means within said upper wiper means, said means also securing said upper and lower wiper means within the bore of the operating string below the smallest internal diameter of the bore of said upper wiper means;

a seal between said upper wiper means and the bore of the operating string; and a seal arrangement to close off communication between the operating string adjacent the lower and upper wiper means and the well bore.

19. Apparatus for forming a closed system with the bore of an operating string for first releasing engaged lower plug and wiper means and then releasing upper plug and wiper means from the operating string to position a substance in a well bore comprising:

lower and upper spaced plug means for wiping the operating string bore ahead of and behind, respectively, the substance;

lower and upper spaced wiper means for wiping ahead of and behind, respectively, the substance upon sealing engagement, respectively with said lower and upper plug means;

said upper wiper means having circumferentially spaced openings to receive the operating string longitudinally therethrough;

shear means connecting each said lower wiper means to the operating string which extends through the circumferential openings into said upper wiper means;

a seal between said upper wiper means and the bore of the operating string; and a seal arrangement to close off communication between the operating string adjacent the lower and upper wiper means and the well bore.

20. Apparatus for forming a closed system with the bore of an operating string for first releasing engaged lower plug and wiper means and then releasing upper plug and wiper means from the operating string to cement a liner in a well bore casing comprising:

lower and upper spaced plug means for wiping the operating string ahead of and behind, respectively, the cement;

lower and upper spaced wiper means for wiping the liner ahead of and behind, respectively, the cement upon sealing engagement, respectively, with said lower and upper plug means for movement through the liner;

said upper wiper means having circumferentially spaced openings to receive the operating string longitudinally therethrough;

shear means connecting each said lower and upper wiper means to the operating string below the smallest internal diameter of said upper wiper means;

a seal between said upper wiper means and the bore of the operating string; and a seal arrangement to close off communication between the operating string adjacent the lower and upper wiper means and the well bore.

21. The apparatus of claim 1, or 2, or 3, or 4, or 5, or 6, or 13, or 15, or 16, or 17, or 18, or 19, or 20 wherein said shear means which connects said lower and upper wiper means to the operating string is located in substantially the same circumferential position and at substantially the same transverse position with respect to the operating string.

22. The apparatus of claim 1, or 2, or 3, or 4, or 5, or 6, or 13, or 15, or 16, or 17, or 18, or 19, or 20 wherein said shear means which connects said lower and upper wiper means to the operating string is located in substantially the same circumferential position and at substantially the same transverse position with respect to the operating string, and wherein said shear means which connects said lower wiper means to the operating string is also located at additional circumferentially spaced positions and at substantially the same transverse positions with respect to the operating string at which said shear means that connects said upper wiper means is secured to the operating string is located.

23. The apparatus of claim 1, or 2, or 3, or 4, or 5, or 6, or 13, or 15, or 16, or 17, or 18, or 19, or 20 wherein said shear means which connects said upper and lower wiper means to the operating string is located in substantially the same circumferential position and at substantially the same transverse position in relation to the longitudinal axis of the operating string and wherein said shear means which connects one of said wiper means is located on the operating string at additional circumferentially spaced positions.

24. The apparatus of claim 1, or 2, or 3, or 4, or 5, or 6, or 13, or 15, or 16, or 17, or 18, or 19, or 20 wherein said shear means which releasably secures said upper and lower wiper means to the operating string is located at substantially the same transverse position in relation to the longitudinal axis of the operating string.

25. The apparatus of claim 1, or 2, or 3, or 4, or 5, or 6, or 13, or 15, or 16, or 17, or 18, or 19, or 20 wherein said shear means which connects said upper and lower wiper means to the operating string is located, respectively, at upper and lower longitudinally spaced positions on the operating string.

26. Apparatus for forming a closed system with the bore of an operating string for first releasing sealably engaged first plug and wiper means and then releasing sealably engaged second plug and wiper means from the operating string to cement a liner in a well bore casing comprising:

first and second spaced plug means for wiping the operating string bore ahead of and behind, respectively, the cement;

first and second wiper means and each wiper means having a longitudinal bore therein for sealably receiving, respectively, said first and second spaced plug means therein for wiping the liner ahead of and behind, respectively, the cement upon sealing engagement, respectively, with said first and second spaced plug means for movement through the liner;

said second wiper means having a portion extending through the operating string and into the bore thereof to receive said second plug means for movement of said second plug and wiper means together;

said second wiper means having circumferentially spaced openings through which the operating string extends longitudinally;

at least one seal between said second wiper means and the bore of the operating string; and a seal arrangement to close off communication between the operating string adjacent the first and second wiper means and the well bore; and shear means for releasably securing said first wiper means to the operating string within said second wiper means and for releasably securing said second wiper means to the operating string.

27. The apparatus of claim 1, or 2, or 3, or 4, or 5, or 6, or 7, or 8, or 15, or 16, or 17, or 18, or 19, or 20, or 26 including seal means for sealing between the liner and the operating string, wherein said seal means comprises:

body means for fitting between the operating string and the liner;

seal means on said body for engaging the liner and operating string for sealing therebetween;

cooperating surface means on the liner, operating string and said body means engageable with each other to lock said body means to the liner for sealing between the liner and operating string while accomodating axial movement of the operating string, said cooperating surface means including a recess in the liner, projection means on said body means engageable in the liner recess; and surface means carried on the operating string to urge said projection means into the recess in the liner to maintain said projection means engaged in the liner recess; and means to unlock said cooperating surface means on the liner and said body means from each other upon a predetermined amount of further relative longitudinal movement between the operating string and said body means whereby said body means may be retrieved with the operating string from the well bore, said means to unlock including additional surface means on the operating string which is positionable when the operating string is moved longitudinally a predetermined amount relative to said body means to release said cooperating surface means on the liner, operating string and said body means from each other; and means for positioning the liner in the well bore, wherein said means for positioning comprises:

hanger means on the liner for securing the liner to the casing in the well bore and means for securing the liner with the hanger means thereon on the operating string whereby the liner and operating string may be disconnected from each other upon relative rotation therebetween, said hanger means including:

at least one cone shaped enlargement on the liner;

at least one sleeve means slidable on the liner;

slip means on said slidable sleeve means;

cooperating latch means on the liner and said slidable sleeve means for releasably securing them together;

said latch means including:

a J-shaped slot in said slidable sleeve means; lug means on the liner and engaged in said slot; and bow spring means on said slidable sleeve means engageable with the well bore casing whereby as the liner and sleeve means move through the well bore casing in one direction said lug means is positioned in said slot to restrain relative longitudinal and rotational movement between the liner and said slidable sleeve means; and said latch means, upon longitudinal movement of the liner in the other direction in the well bore casing and then rotating it while said slidable sleeve means is restrained by said bow spring means engaging the well bore casing, releasing to accommodate longitudinal movement of said slip means relative to the liner to engage said slip means and cone shaped enlargement for urging said slip means radially into gripping engagement with the well bore casing.

28. The apparatus of claim 1, or 2, or 3, or 4, or 5, or 6, or 7, or 8, or 15, or 16, or 17, or 18, or 19, or 20, or 26 including seal means for sealing between the liner and the operating string, wherein said seal means comprises:

body means for fitting between the operating string and the liner;

seal means on said body for engaging the liner and operating string for sealing therebetween;

cooperating surface means on the liner, operating string and said body means engageable with each other to lock said body means to the liner for sealing between the liner and operating string while accommodating axial movement of the operating string, said cooperating surface means including a recess in the liner, projection means on said body means engageable in the liner recess; and surface means carried on the operating string to urge said projection means into the recess in the liner to maintain projection means engaged in the liner recess; and means to unlock said cooperating surface means on the liner and said body means from each other upon a predetermined amount of further relative longitudinal movement between the operating string and said body means whereby said body means may be retrieved with the operating string from the well bore, said means to unlock including additional surface means on the operating string which is positionable when the operating string is moved longitudinally a predetermined amount relative to said body means to release said cooperating surface means on the liner, operating string and said body means from each other; and means for positioning the liner in the well bore, wherein said means for positioning comprises:

hanger means on the liner for securing the liner to the casing in the well bore and means for securing the liner with the hanger means thereon on the operating string whereby the liner and operating string may be disconnected from each other upon relative rotation therebetween, said hanger means including:

at least one cone shaped enlargement on the liner;

at least one sleeve means slidable on the liner;

slip means on said slidable sleeve means;

the liner having at least one annular chamber thereon in which one end of one of said slidable sleeve means is telescopically received;

seal means sealing between the annular chamber and said slidable sleeve means responsive to fluid pressure through port means in the liner for moving said slidable sleeve means longitudinally for engagement of said slip means with said cone shaped enlargement for urging said slip means radially into gripping engagement with the well bore casing; and means for restricting fluid flow through the operating string for supplying fluid pressure from the operating string through the port means therein to the annular chamber.

29. The apparatus of claim 1, or 2, or 3, or 4, or 5, or 6, or 7, or 8, or 15, or 16, or 17, or 18, or 19, or 20, or 26 including seal means for sealing between the liner and the operating string, wherein said seal means comprises:

body means for fitting between the operating string and the liner;

seal means on said body for engaging the liner and operating string for sealing therebetween;

cooperating surface means on the liner, operating string and said body means engageable with each other to lock said body means to the liner for sealing between the liner and operating string while accommodating axial movement of the operating string, said cooperating surface means including a recess in the liner, projection means on said body means engageable in the liner recess; and surface means carried on the operating string to urge said projection means into the recess in the liner to maintain said projection means engaged in the liner recess; and means to unlock said cooperating surface means on the liner and said body means from each other upon a predetermined amount of further relative longitudinal movement between the operating string and said body means whereby said body means may be retrieved with the operating string from the well bore, said means to unlock including additional surface means on the operating string which is positionable when the operating string is moved longitudinally a predetermined amount relative to said body means to release said cooperating surface means on the liner, operating string and said body means from each other;

means for positioning the liner in the well bore, wherein said means for positioning comprises:

means to rotate and reciprocate the liner before supporting it on the well bore casing and for rotating the liner after it is supported on the well bore casing comprising:

inner and outer telescopically arranged members;

said outer member having the liner secured thereto;

1. hanger means supported on the liner for hanging the liner on the well bore casing; and
2. bearing means on said outer member to accommodate rotation of said outer member and the liner relative to the casing and said hanger means;

said inner member having a non-circular mandrel connected with the operating string;

means supporting said outer member and the liner on said inner member, said means including:

1. thread means on said outer member; and
2. disengaging nut means threadedly secured on said thread means telescopically receiving said mandrel whereby longitudinal movement and then rotation of the operating string disconnects said disengaging nut means from said thread means and releases said outer member from said inner member and the operating string;

means on said inner and outer members to reciprocate and rotate the liner by manipulating the operating string before the liner is supported on the casing;

said means to reciprocate before supporting the liner on the casing including shoulder means on said disengaging nut means and abutting shoulder means on said inner member whereby the liner may be reciprocated in the well bore by raising and lowering the operating string;

said means to rotate before supporting the liner on the casing including first longitudinal slot means in said outer member and spring biased longitudinal key means on said inner member engaged in said slot means whereby the liner may be rotated by rotating the operating string; and additional means on said inner and outer members releasably engageable after said inner and outer members are released from each other to rotate said outer member and liner relative to said hanger means and the casing upon rotating the operating string, said additional means including inter-fitting groove and circumferentially spaced rigid projection means formed adjacent the upper end of said outer member and the lower end of the operating string respectively.

30. The apparatus of claim 1, or 2, or 3, or 4, or 5, or 6, or 7, or 8, or 15, or 16, or 17, or 18, or 19, or 20, or 26 including seal means for sealing between the liner and the operating string, wherein said seal means comprises:

body means for fitting between the operating string and the liner;

seal means on said body for engaging the liner and operating string for sealing therebetween;

cooperating surface means on the liner, operating string and said body means engageable with each other to lock said body means to the liner for sealing between the liner and operating string while accommodating axial movement of the operating string, said cooperating surface means including a recess in the liner, projection means on said body means engageable in the liner recess; and surface means carried on the operating string to urge said projection means into the recess in the liner to maintain said projection means engaged in the liner recess; and means to unlock said cooperating surface means on the liner and said body means from each other upon a predetermined amount of further relative longitudinal movement between the operating string and said body means whereby said body means may be retrieved with the operating string from the well bore, said means to unlock including additional surface means on the operating string which is positionable when the operating string is moved longitudinally a predetermined amount relative to said body means to release said cooperating surface means on the liner, operating string and said body means from each other;

means for positioning the liner in the well bore, wherein said means for positioning comprises:

means to rotate and reciprocate the liner before supporting it on the well bore casing and for rotating the liner after it is supported on the well bore casing comprising:

inner and outer telescopically arranged members;

said outer member having the liner secured thereto;

1. hanger means supported on the liner for hanging the liner on the well bore casing; and
2. bearing means on said outer member to accommodate rotation of said outer member and the liner relative to the casing and said hanger means;

said inner member having a non-circular mandrel connected with the operating string;

means supporting said outer member and the liner on said inner member, said means including:

1. thread means on said outer member; and
2. disengaging nut means threadedly secured on said thread means telescopically receiving said mandrel whereby longitudinal movement and then rotation of the operating string disconnects said disengaging nut means from said thread means and releases said outer member from said inner member and the operating string;

means on said inner and outer members to reciprocate and rotate the liner by manipulating the operating string before the liner is supported on the casing;

said means to reciprocate before supporting the liner on the casing including shoulder means on said disengaging nut means and abutting shoulder means on said inner member whereby the liner may be reciprocated in the well bore by raising and lowering the operating string;

said means to rotate before supporting the liner on the casing including first longitudinal slot means in said outer member and spring biased longitudinal key means on said inner member engaged in said slot means whereby the liner may be rotated by rotating the operating string; and additional means on said inner and outer members releasably engageable after said inner and outer members are released from each other to rotate said outer member and liner relative to said hanger means and the casing upon rotating the operating string, said additional means including interfitting groove and circumferentially spaced rigid projection means formed adjacent the upper end of said outer member and the lower end of the operating string, respectively.

31. The apparatus of claim 1, or 2, or 3, or 4, or 5, or 6, or 7, or 8, or 15, or 16, or 17, or 18, or 19, or 20, or 26 including seal means for sealing between the liner and the operating string, wherein said seal means comprises:

body means for fitting between the operating string and the liner;

seal means on said body for engaging the liner and operating string for sealing therebetween;

cooperating surface means on the liner, operating string and said body means engageable with each other to lock said body means to the liner for sealing between the liner and operating string while accommodating axial movement of the operating string, said cooperating surface means including a recess in the liner, projection means on said body means engageable in the liner recess; and surface means carried on the operating string to urge said projection means into the recess in the liner to maintain said projection means engaged in the liner recess; and means to unlock said cooperating surface means on the liner and said body means from each other upon a predetermined amount of further relative longitudinal movement between the operating string and said body means whereby said body means may be retrieved with the operating string from the well bore, said means to unlock including additional surface means on the operating string which is positionable when the operating string is moved longitudinally a predetermined amount relative to said body means to release said cooperating surface means on the liner, operating string and said body means from each other;

means for positioning the liner in the well bore, wherein said means for positioning comprises:

hanger means for hanging the liner on the well casing;

means for releasably connecting the operating string with the liner and said liner hanger means;

said hanger means including:

first sleeve means mounted on the liner for rotation of the liner relative thereto;

at least two longitudinally spaced annular rows of conically shaped, circumferentially spaced segments on said first sleeve means with the segments in each row being off-set circumferentially;

second sleeve means slidably mounted on the liner for relative rotation and longitudinal movement between said second sleeve means and the liner, said second sleeve means being spaced from said first sleeve means;

at least two rows of hanger slips supported by said second sleeve means with said hanger slips in each row being off-set circumferentially and with said hanger slips in each row being aligned with the segments in a row of segments;

means secured to said hanger slips adjacent one end and to said second sleeve means at the other end;

release means for releasably securing said second sleeve means to the liner whereby said second sleeve means may be released for relative longitudinal movement between it and said first sleeve means to simultaneously engage all said rows of hanger slips on said respective rows of conical segments to hang the liner in the well bore casing by said hanger means;

said release means including:

a J-shaped slot in said second sleeve means;

lug means on the liner and engaged in said slot; bow spring means on said second sleeve means engageable with the well bore casing whereby as the liner and said first and second sleeve means move through the well bore casing in one direction said lug means is positioned in said slot to restrain relative longitudinal movement between the liner and said second sleeve means; and said latch means, upon longitudinal movement of the liner in the other direction in the well bore casing and then rotating it while said second sleeve means is restrained by said bow spring means engaging the well bore casing, releasing to accommodate longitudinal movement of said second sleeve means relative to the liner to engage said hanger slips and conical segments for urging said hanger slips radially into gripping engagement with the well bore casing;

bearing means on the liner to accommodate rotation of the liner; and cooperating means on the operating string and liner to rotate and reciprocate the liner before hanging it and for rotating the liner after it is hung on the well bore casing.

32. The apparatus of claim 1, or 2, or 3, or 4, or 5, or 6, or 7, or 8, or 15, or 16, or 17, or 18, or 19, or 20, or 26 including seal means for sealing between the liner and the operating string, wherein said seal means comprises:

body means for fitting between the operating string and the liner;

seal means on said body for engaging the liner and operating string for sealing therebetween;

cooperating surface means on the liner, operating string and said body means engageable with each other to lock said body means to the liner for sealing between the liner and operating string while accommodating axial movement of the operating string, said cooperating surface means including a recess in the liner, projection means on said body means engageable in the liner recess; and surface means carried on the operating string to urge said projection means into the recess in the liner to maintain said projection means engaged in the liner recess; and means to unlock said cooperating surface means on the liner and said body means from each other upon a predetermined amount of further relative longitudinal movement between the operating string and said body means whereby said body means may be retrieved with the operating string from the well bore, said means to unlock including additional surface means on the operating string which is positionable when the operating string is moved longitudinally a predetermined amount relative to said body means to release said cooperating surface means on the liner, operating string and said body means from each other;

means for positioning the liner in the well bore, wherein said means for positioning comprises:

hanger means for hanging the liner on the well bore casing;

means for releasably connecting the operating string with the liner and said liner hanger means;

said hanger means including:

first sleeve means mounted on the liner for rotation of the liner relative thereto;

at least two longitudinally spaced annular rows of conically shaped, circumferentially spaced segments on said first sleeve means with the segments in each row being off-set circumferentially;

second sleeve means slidably mounted on the liner for relative rotation and longitudinal movement between said second sleeve means and the liner, said second sleeve means being spaced from said first sleeve means;

at least two rows of hanger slips supported by said second sleeve means with said hanger slips in each row being off-set circumferentially and with said hanger slips in each row being aligned with the segments in a row of segments;

means secured to said hanger slips adjacent one end and to said second sleeve means at the other end;

release means for releasably securing said second sleeve means to the liner whereby said second sleeve means may be released for relative longitudinal movement between it and said first sleeve means to simultaneously engage all said rows of hanger slips on said respective rows of conical segments to hang the liner in the well bore casing by said hanger means;

said release means including:

an annular longitudinally extending chamber in the liner in which one end of said second sleeve means is telescopically received; and seal means sealing between the annular chamber and said second sleeve means responsive to fluid pressure through a port in the liner for moving said second sleeve means longitudinally for engagement of said hanger slips with said conical segments for urging said hanger slips radially into gripping engagement with the well bore casing;

bearing means on the liner to accommodate rotation of the liner; and cooperating means on the operating string and liner to rotate and reciprocate the liner before hanging it and for rotating the liner after it is hung on the well bore casing.

33. The apparatus of claim 1, or 2, or 3, or 4, or 5, or 6, or 7, or 8, or 15, or 16, or 17, or 18, or 19, or 20, or 26 wherein said lower wiper means and operating string are secured together against relative rotation.

34. The apparatus of claim 1, or 2, or 3, or 4, or 5, or 6, or 7, or 8, or 15, or 16, or 17, or 18, or 19, or 20, or 26 wherein the operating string includes a plurality of circumferentially spaced fingers and wherein said lower wiper means includes recesses to receive said fingers to secure the operating string and said lower wiper means against relative rotation.

35. Apparatus for use in a well bore with lower and upper wiper means each releasably supported on an operating string having a bore and wherein the lower and upper wiper means sealably receive lower and upper plug means, respectively, and being then releasable from the operating string for wiping ahead of and behind, respectively, a substance prior to its discharge into the well bore, said apparatus including:

a member:

said member having a longitudinal bore therethrough;

cooperating surfaces on the upper wiper means and said member to secure said member to the upper wiper means;

seal means for sealably engaging between said upper wiper means and the bore of the operating string; and seal means for sealably engaging between said member and the lower and upper wiper means.

36. A seal arrangement for closing off communication between a well bore and the bore of an operating string adjacent lower and upper wipers releasably supported in relation to the operating string, said seal arrangement comprising:

at least one seal between the bore of the operating string and the upper wiper;

at least one seal closing off communication between the upper wiper and the exterior of the operating string; and at least one seal between the lower and upper wipers.

37. In apparatus for discharging a substance through the bore of an operating string and into a well bore wherein the operating string has lower and upper wiper means thereon, the invention comprising:

shear means on the operating string connecting the lower wiper means thereto;

shear means on the operating string connecting the upper wiper means thereto; and a seal arrangement to close off communication between the operating string adjacent the lower and upper wiper means and the well bore.

38. The apparatus of claims 12, 13, 15, 16, 17, 18, 19, 20, 26, and 37 wherein said seal arrangement includes a seal between the upper and lower wiper means.

39. A seal arrangement for closing off communication between a well bore and the bore of an operating string adjacent lower and upper plug means sealably engaged, respectively, in lower and upper wiper means releasably and sealably supported in relation to the operating string to wipe ahead of and behind a substance discharged through the operating string bore, said seal arrangement comprising:

seals to close off communication between the operating string bore and the well bore when said lower plug means is sealingly engaged in said lower wiper means whereby pressure in the operating string is effective to release said engaged lower plug and wiper means from the operating string; and additional seals to close off communication between the operating string bore and the well bore when said upper plug means is sealingly engaged in said upper wiper means whereby pressure in the operating string is effective to release said engaged upper plug and wiper means from the operating string.

40. Apparatus for cementing a liner in a well bore casing wherein the cement enters the liner through the bore of an operating string and flows through the liner to the cementing region, comprising:

lower and upper spaced plug means for wiping the operating string bore ahead of and behind, respectively, the cement;

lower and upper spaced wiper means for wiping the liner ahead of and behind, respectively, the cement upon sealing engagement, respectively, with said lower and upper plug means for movement through the liner;

shear means connecting said lower and upper wiper means to the operating string which operating string extends through the longitudinal bore of said upper wiper means to terminate, respectively, adjacent the lower and upper ends of said upper and lower wiper means and in overlapping relation with said lower wiper means;

seals to close off communication between the operating string bore and the well bore when said lower plug means is sealingly engaged in said lower wiper means whereby pressure in the operating string is effective to actuate said shear means and release said engaged lower plug and wiper means from the operating string;

additional seals to close off communication between the operating string bore and the well bore when said upper plug means is sealingly engaged in said upper wiper means whereby pressure in the operating string is effective to actuate said shear means and release said engaged upper plug and wiper means from the operating string;

latch means for latching said lower plug means with said lower wiper means;

means for locking said latch means against premature separation as said engaged lower plug and wiper means move through the liner;

means for catching said lower wiper means in the liner;

means for unlocking said lower plug means from said lower wiper means for movement of said lower plug means longitudinally relative to said lower plug means when said catching means catches said lower wiper means whereby the cement from between said lower wiper means and upper wiper and plug means may pass out the liner to the cementing region;

one-way valve means supported by the liner for preventing backflow of the cement into the liner; and means for securing said lower wiper means and said upper wiper and plug means together as a unit in said catcher means after displacement of the cement to the cementing region.

41. Apparatus for cementing a liner in a well bore casing wherein the cement enters the liner through the bore of an operating string and flows through the liner to the cementing region, comprising:

lower and upper spaced plug means for wiping the operating string ahead of and behind, respectively, the cement;

lower and upper spaced wiper means each with a longitudinal bore therein for sealably receiving, respectively, said lower and upper spaced plug means for wiping the liner ahead of and behind, respectively, the cement upon sealing engagement, respectively, with said lower and upper plug means for movement through the liner;

said upper wiper means surrounding the lower end of the operating string and extending through and into the bore of the operating string;

shear means connecting said lower wiper means within said upper wiper means, said means also securing said upper and lower wiper means within the bore of the operating string below the smallest internal diameter of the bore of said upper wiper means;

seals to close off communication between the operating string bore and the well bore when said lower plug means is sealingly engaged in said lower wiper means whereby pressure in the operating string is effective to actuate said shear means and release said engaged lower plug and wiper means from the operating string;

additional seals to close off communication between the operating string bore and the well bore when said upper plug means is sealingly engaged in said upper wiper means whereby pressure in the operating string is effective to actuate said shear means and release said engaged upper plug and wiper means from the operating string;

latch means for latching said lower plug means with said lower wiper means;

means for locking said latch means against premature separation as said engaged lower plug and wiper means move through the liner;

means for catching said lower wiper means in the liner;

means for unlocking said lower plug means from said lower wiper means for movement of said lower plug means longitudinally relative to said lower plug means when said catching means catches said lower wiper means whereby the cement from between said lower wiper means and upper wiper and plug means may pass out the liner to the cementing region;

one-way valve means supported by the liner for preventing backflow of the cement into the liner; and means for securing said lower wiper means and said upper wiper and plug means together as a unit in said catcher means after displacement of the cement to the cementing region.

42. Apparatus for cementing a liner in a well bore casing wherein the cement enters the liner through the bore of an operating string and flows through the liner to the cementing region, comprising:

lower and upper spaced plug means for wiping the operating string bore ahead of and behind, respectively, the cement;

lower and upper spaced wiper means for wiping the liner ahead of and behind, respectively, the cement upon engagement, respectively with said lower and upper plug means for movement through the liner;

said upper wiper means having circumferentially spaced openings to receive the operating string longitudinally therethrough;

shear means connecting said lower wiper means to the operating string which extends through the circumferential openings into said upper wiper means;

seals to close off communication between the operating string bore and the well bore when said lower plug means in engaged in said lower wiper means whereby pressure in the operating string is effective to actuate said shear means and release said engaged lower plug and wiper means from the operating string;

additional seals to close off communication between the operating string bore and the well bore when said upper plug means is engaged in said upper wiper means whereby pressure in the operating string is effective to actuate said shear means and release said engaged upper plug and wiper means from the operating string;

latch means for latching said lower plug means with said lower wiper means;

means for locking said latch means against premature separation as said engaged lower plug and wiper means move through the liner;

means for catching said lower wiper means in the liner;

means for unlocking said lower plug means from said lower wiper means for movement of said lower plug means longitudinally relative to said lower plug means when said catching means catches said lower wiper means whereby the cement from between said lower wiper means and upper wiper and plug means may pass out the liner to the cementing region;

one-way valve means supported by the liner for preventing backflow of the cement into the liner; and means for securing said lower wiper means and said upper wiper and plug means together as a unit in said catcher means after displacement of the cement to the cementing region.

43. Apparatus for cementing a liner in a well bore casing wherein the cement enters the liner through the bore of an operating string and flows through the liner to the cementing region, comprising:

lower and upper spaced plug means for wiping the operating string ahead of and behind, respectively, the cement;

lower and upper spaced wiper means for wiping the liner ahead of and behind, respectively, the cement upon engagement, respectively, with said lower and upper plug means for movement through the liner;

said upper wiper means having circumferentially spaced openings to receive the operating string longitudinally therethrough;

shear means connecting each said lower and upper wiper means to the operating string below the smallest internal diameter of said upper wiper means;

seals to close off communication between the operating string bore and the well bore when said lower plug means is engaged in said lower wiper means whereby pressure in the operating string is effective to actuate said shear means and release said engaged lower plug and wiper means from the operating string;

additional seals to close off communication between the operating string bore and the well bore when said upper plug means is engaged in said upper wiper means whereby pressure in the operating string is effective to actuate said shear means and release said engaged upper plug and wiper means from the operating string;

latch means for latching said lower plug means with said lower wiper means;

means for locking said latch means against premature separation as said engaged lower plug and wiper means move through the liner;

means for catching said lower wiper means in the liner;

means for unlocking said lower plug means from said lower wiper means for movement of said lower plug means longitudinally relative to said lower plug means when said catching means catches said lower wiper means whereby the cement from between said lower wiper means and upper wiper and plug means may pass out the liner to the cementing region;

one-way valve means supported by the liner for preventing backflow of the cement into the liner; and means for securing said lower wiper means and said upper wiper and plug means together as a unit in said catcher means after displacement of the cement to the cementing region.

44. Apparatus for cementing a liner in a well bore casing wherein the cement enters the liner through the bore of an operating string and flows through the liner to the cementing region, comprising:

lower and upper spaced plug means for wiping the operating string bore ahead of and behind, respectively, the cement;

lower and upper wiper means for wiping the liner ahead of and behind, respectively, the cement upon engagement, respectively, with said lower and upper plug means for movement through the liner;

said upper wiper means having a portion extending through the operating string and into the bore thereof to receive said upper plug means for movement of said upper wiper and plug means together through the liner;

shear means connecting said lower and upper wiper means to the operating string;

seals to close off communication between the operating string bore and the well bore when said lower plug means is engaged in said lower wiper means whereby pressure in the operating string is effective to actuate said shear means and release said engaged lower plug and wiper means from the operating string;

additional seals to close off communication between the operating string bore and the well bore when said upper plug means is engaged in said upper wiper means whereby pressure in the operating string is effective to actuate said shear means and release said engaged upper plug and wiper means from the operating string;

latch means for latching said lower plug means with said lower wiper means;

means for locking said latch means against premature separation as said engaged lower plug and wiper means move through the liner;

means for catching said lower wiper means in the liner;

means for unlocking said lower plug means from said lower wiper means for movement of said lower plug means longitudinally relative to said lower plug means when said catching means catches said lower wiper means whereby the cement from between said lower wiper means and upper wiper and plug means may pass out the liner to the cementing region;

one-way valve means supported by the liner for preventing backflow of the cement into the liner; and means for securing said lower wiper means and said upper wiper and plug means together as a unit in said catcher means after displacement of the cement to the cementing region.

45. Apparatus for cementing a liner in a well bore casing wherein the cement enters the liner through the bore of an operating string and flows through the liner to the cementing region, comprising:

first and second spaced plug means for wiping the operating string bore ahead of and behind, respectively, the cement;

first and second wiper means, each having a longitudinal bore therein for receiving, respectively, said first and second spaced plug means therein for wiping the liner ahead of and behind, respectively, the cement upon engagement, respectively, with said first and second spaced plug means for movement through the liner;

said second wiper means having circumferentially spaced openings through which the operating string extends longitudinally;

shear means connecting said first wiper means adjacent the operating string which extends through the circumferential openings and adjacent the lower end of said second wiper means so that the longitudinal bore of said first wiper means originates and extends away from adjacent said lower end of the operating string and said second wiper means;

seals to close off communication between the operating string bore and the well bore when said first plug means is engaged in said first wiper means whereby pressure in the operating string is effective to actuate said shear means and release said engaged first plug and wiper means from the operating string;

additional seals to close off communication between the operating string bore and the well bore when said second plug means is engaged in said second wiper means whereby pressure in the operating string is effective to actuate said shear means and release said engaged second plug and wiper means from the operating string;

latch means for latching said first plug means with said first wiper means;

means for locking said latch means against premature separation as said engaged first plug and wiper means move through the liner;

means for catching said first wiper means in the liner;

means for unlocking said first plug means from said first wiper means for movement of said first plug means longitudinally relative to said first plug means when said catching means catches said first wiper means whereby the cement from between said first wiper means and second wiper and plug means may pass out the liner to the cementing region;

one-way valve means supported by the liner for preventing backflow of the cement into the liner; and means for securing said first wiper means and said second wiper and plug means together as a unit in said catcher means after displacement of the cement to the cementing region.

46. Apparatus for cementing a liner in a well bore casing wherein the cement enters the liner through the bore of an operating string and flows through the liner to the cementing region, comprising:

first and second spaced plug means for wiping the operating string bore ahead of and behind, respectively, the cement;

first and second wiper means, each having a longitudinal bore therein for receiving, respectively, said first and second spaced plug means therein for wiping the liner ahead of and behind, respectively, the cement upon engagement, respectively, with said first and second spaced plug means for movement through the liner;

said second wiper means having a portion extending through the operating string and into the bore thereof to receive said second plug means for movement of said second plug and wiper means together;

said second wiper means having circumferentially spaced openings through which the operating string extends longitudinally;

shear means connecting said first wiper means adjacent the operating string which extends through the circumferential openings;

seals to close off communication between the operating string bore and the well bore when said first plug means is engaged in said first wiper means whereby pressure in the operating string is effective to actuate said shear means and release said engaged first plug and wiper means from the operating string;

additional seals to close off communication between the operating string bore and the well bore when said second plug means is engaged in said second wiper means whereby pressure in the operating string is effective to actuate said shear means and release said engaged second plug and wiper means from the operating string;

latch means for latching said first plug means with said first wiper means;

means for locking said latch means against premature separation as said engaged first plug and wiper means move through the liner;

means for catching said first wiper means in the liner;

means for unlocking said first plug means from said first wiper means for movement of said first plug means longitudinally relative to said first plug means when said catching means catches said first wiper means whereby the cement from between said first wiper means and second wiper and plug means may pass out the liner to the cementing region;

one-way valve means supported by the liner for preventing backflow of the cement into the liner; and means for securing said first wiper means and said second wiper and plug means together as a unit in said catcher means after displacement of the cement to the cementing region.

47. Apparatus for cementing a liner in a well bore casing wherein the cement enters the liner through the bore of an operating string and flows through the liner to the cementing region, comprising:

lower and upper spaced plug means for wiping the operating string bore ahead of and behind, respectively, the cement;

lower and upper spaced wiper means for wiping the liner ahead of and behind, respectively, the cement upon engagement, respectively with said lower and upper plug means for movement through the liner;

said upper wiper means having circumferentially spaced openings to receive the operating string longitudinally therethrough;

at least one seal between said upper wiper means and the bore of the operating string;

a seal arrangement to close off communication between the operating string adjacent the lower and upper wiper means and the well bore;

shear means connecting said lower wiper means to the operating string within said upper wiper means and for releasably securing said upper wiper means to the operating string;

latch means for latching said lower plug means with lower wiper means;

means for locking said latch means against premature separation as said engaged lower plug and wiper means move through the liner;

means for catching said lower wiper means in the liner;

means for unlocking said lower plug means from said lower wiper means for movement of said lower plug means longitudinally relative to said lower plug means when said catching means catches said lower wiper means whereby the cement from between said lower wiper means and upper wiper and plug means may pass out the liner to the cementing region;

one-way valve means supported by the liner for preventing backflow of the cement into the liner; and means for securing said lower wiper means and said upper wiper and plug means together as a unit in said catcher means after displacement of the cement to the cementing region.

48. Apparatus for cementing a liner in a well bore casing wherein the cement enters the liner through the bore of an operating string and flows through the liner to the cementing region, comprising:

lower and upper spaced plug means for wiping the operating string bore ahead of and behind, respectively, the cement;

lower and upper spaced wiper means for wiping the liner ahead of and behind, respectively, the cement upon engagement, respectively with said lower and upper plug means for movement through the liner;

said upper wiper means having a portion extending through the operating string and into the bore thereof to receive said upper plug means for movement of said upper wiper and plug means together through the liner;

at least one seal between said upper wiper means and the bore of the operating string;

a seal arrangement to close off communication between the operating string adjacent the lower and upper wiper means and the well bore;

shear means connecting said lower and upper wiper means to the operating string;

latch means for latching said lower plug means with said lower wiper means;

means for locking said latch means against premature separation as said engaged lower plug and wiper means move through the liner;

means for catching said lower wiper means in the liner;

means for unlocking said lower plug means from said lower wiper means for movement of said lower plug means longitudinally relative to said lower plug means when said catching means catches said lower wiper means whereby the cement from between said lower wiper means and upper wiper and plug means may pass out the liner to the cementing region;

one-way valve means supported by the liner for preventing backflow of the cement into the liner; and means for securing said lower wiper means and said upper wiper and plug means together as a unit in said catcher means after displacement of the cement to the cementing region.

49. Apparatus for cementing a liner in a well bore casing wherein the cement enters the liner through the bore of an operating string and flows through the liner to the cementing region, comprising:

lower and upper spaced plug means for wiping the operating string bore ahead of and behind, respectively, the cement;

lower and upper spaced wiper means for wiping the liner ahead of and behind, respectively, the cement upon engagement, respectively with said lower and upper plug means for movement through the liner;

at least one seal between said upper wiper means and the bore of the operating string;

a seal arrangement to close off communication between the operating string adjacent the lower and upper wiper means and the well bore;

shear means connecting said lower and upper wiper means to the operating string;

latch means for latching said lower plug means with said lower wiper means;

means for locking said latch means against premature separation as said engaged lower plug and wiper means move through the liner;

means for catching said lower wiper means in the liner;

means for unlocking said lower plug means from said lower wiper means for movement of said lower plug means longitudinally relative to said lower plug means when said catching means catches said lower wiper means whereby the cement from between said lower wiper means and upper wiper and plug means may pass out the liner to the cementing region;

one-way valve means supported by the liner for preventing backflow of the cement into the liner; and means for securing said lower wiper means and said upper wiper and plug means together as a unit in said catcher means after displacement of the cement to the cementing region.

50. Apparatus for cementing a liner in a well bore casing wherein the cement enters the liner through the bore of an operating string and flows through the liner to the cementing region, comprising:

lower and upper spaced plug means for wiping the operating string bore ahead of and behind, respectively, the cement;

lower and upper spaced wiper means for wiping the liner ahead of and behind, respectively, the cement upon sealing engagement, respectively, with said lower and upper plug means for movement through the liner;

a seal between said upper wiper means and the bore of the operating string;

a seal arrangement to close off communication between the operating string adjacent the lower and upper wiper means and the well bore;

shear means connecting said lower and upper wiper means to the operating string;

said seal arrangement including a seal between said upper and lower wiper means.

latch means for latching said lower plug means with said lower wiper means;

means for locking said latch means against premature separation as said engaged lower plug and wiper means move through the liner;

means for catching said lower wiper means in the liner;

means for unlocking said lower plug means from said lower wiper means for movement of said lower plug means longitudinally relative to said lower plug means when said catching means catches said lower wiper means whereby the cement from between said lower wiper means and upper wiper and plug means may pass out the liner to the cementing region;

one-way valve means supported by the liner for preventing backflow of the cement into the liner; and means for securing said lower wiper means and said upper wiper and plug means together as a unit in said catcher means after displacement of the cement to the cementing region.

51. Apparatus for cementing a liner in a well bore casing wherein the cement enters the liner through the bore of an operating string and flows through the liner to the cementing region, comprising:

lower and upper spaced plug means for wiping the operating string ahead of and behind, respectively, the cement;

lower and upper spaced wiper means and each wiper means having a longitudinal bore therein for receiving, respectively, said lower and upper spaced plug means for wiping the liner ahead of and behind, respectively, the cement upon sealing engagement, respectively, with said lower and upper plug means for movement through the liner;

said upper wiper means surrounding the lower end of the operating string and extending through and into the bore of the operating string;

shear means connecting said lower wiper means within said upper wiper means, said means also securing said upper and lower wiper means within the bore of the operating string below the smallest internal diameter of the bore of said upper wiper means;

a seal between said upper wiper means and the bore of the operating string;

a seal arrangement to close off communication between the operating string adjacent the lower and upper wiper means and the well bore;

latch means for latching said lower plug means with said lower wiper means;

means for locking said latch means against premature separation as said engaged lower plug and wiper means move through the liner;

means for catching said lower wiper means in the liner;

means for unlocking said lower plug means from said lower wiper means for movement of said lower plug means longitudinally relative to said lower plug means when said catching means catches said lower wiper means whereby the cement from between said lower wiper means and upper wiper and plug means may pass out the liner to the cementing region;

one-way valve means supported by the liner for preventing backflow of the cement into the liner; and means for securing said lower wiper means and said upper wiper and plug means together as a unit in said catcher means after displacement of the cement to the cementing region.

52. Apparatus for cementing a liner in a well bore casing wherein the cement enters the liner through the bore of an operating string and flows through the liner to the cementing region, comprising:

lower and upper spaced plug means for wiping the operating string bore ahead of and behind, respectively, the cement;

lower and upper spaced wiper means for wiping the liner ahead of and behind, respectively, the cement upon engagement, respectively with said lower and upper plug means for movement through the liner;

said upper wiper means having circumferentially spaced openings to receive the operating string longitudinally therethrough;

shear means connecting said lower wiper means to the operating string which extends through the circumferential openings into said upper wiper means; which extends through the circumferential openings into said upper wiper means;

a seal between said upper wiper means and the bore of the operating string;

a seal arrangement to close off communication between the operating string adjacent the lower and upper wiper means and the well bore;

latch means for latching said lower plug means with said lower wiper means;

means for locking said latch means against premature separation as said engaged lower plug and wiper means move through the liner;

means for catching said lower wiper means in the liner;

means for unlocking said lower plug means from said lower wiper means for movement of said lower plug means longitudinally relative to said lower plug means when said catching means catches said lower wiper means whereby the cement from between said lower wiper means and upper wiper and plug means may pass out the liner to the cementing region;

one-way valve means supported by the liner for preventing backflow of the cement into the liner; and means for securing said lower wiper means and said upper wiper and plug means together as a unit in said catcher means after displacement of the cement to the cementing region.

53. Apparatus for cementing a liner in a well bore casing wherein the cement enters the liner through the bore of an operating string and flows through the liner to the cementing region, comprising:

lower and upper spaced plug means for wiping the operating string ahead of and behind, respectively, the cement;

lower and upper spaced wiper means for wiping the liner ahead of and behind, respectively, the cement upon engagement, respectively, with said lower and upper plug means for movement through the liner;

said upper wiper means having circumferentially spaced openings to receive the operating string longitudinally therethrough;

shear means connecting each said lower and upper wiper means to the operating string below the smallest internal diameter of said upper wiper means;

a seal between said upper wiper means and the bore of the operating string;

a seal arrangement to close off communication between the operating string adjacent the lower and upper wiper means and the well bore;

latch means for latching said lower plug means with said lower wiper means;

means for locking said latch means against premature separation as said engaged lower plug and wiper means move through the liner;

means for catching said lower wiper means in the liner;

means for unlocking said lower plug means from said lower wiper means for movement of said lower plug means longitudinally relative to said lower plug means when said catching means catches said lower wiper means whereby the cement from between said lower wiper means and upper wiper and plug means may pass out the liner to the cementing region;

one-way valve means supported by the liner for preventing backflow of the cement into the liner; and means for securing said lower wiper means and said upper wiper and plug means together as a unit in said catcher means after displacement of the cement to the cementing region.

54. Apparatus for cementing a liner in a well bore casing wherein the cement enters the liner through the bore of an operating string and flows through the liner to the cementing region, comprising:

first and second spaced plug means for wiping the operating string bore ahead of and behind, respectively, the cement;

first and second wiper means and each wiper means having a longitudinal bore therein for receiving, respectively, said first and second spaced plug means therein for wiping the liner ahead of and behind, respectively, the cement upon engagement, respectively, with said first and second spaced plug means for movement through the liner;

said second wiper means having a portion extending through the operating string and into the bore thereof to receive said second plug means for movement of said second plug and wiper means together;

said second wiper means having circumferentially spaced openings through which the operating string extends longitudinally;

at least one seal between said second wiper means and the bore of the operating string;

a seal arrangement to close off communication between the operating string adjacent the first and second wiper means and the well bore;

shear means said first wiper means to the operating string within said second wiper means and connecting said second wiper means adjacent the operating string which extends through the circumferential openings;

latch means for latchin said first plug means with said first wiper means;

means for locking said latch means against premature separation as said engaged first plug and wiper means move through the liner;

means for catching said first wiper means in the liner;

means for unlocking said first plug means from said first wiper means for movement of said first plug means longitudinally relative to said first plug means when said catching means catches said first wiper means whereby the cement from between said first wiper means and second wiper and plug means may pass out the liner to the cementing region;

one-way valve means supported by the liner for preventing backflow of the cement into the liner; and means for securing said first wiper means and said second wiper and plug means together as a unit in said catcher means after displacement of the cement to the cementing region.

55. An arrangement for conducting a substance through the bore of an operating string and wherein lower and upper wiper means are releasably supported in relation to the operating string to sealably receive lower and upper plug means to wipe ahead of and behind the substance for discharge into the well bore, said arrangement including:

first seal means between the operating string bore and the upper wiper means;

second seal means to close off communication between the operating string adjacent the lower and upper wiper means and the well bore; and the upper wiper means extending into the operating string bore and the operating string extending through the upper wiper means to terminate in overlapping relation with the lower wiper means whereby the upper and lower wiper means are each releasably supported on the operating string.

56. The arrangement of claim 55 wherein shear means on the operating string connects each the lower and upper wiper means for release from the operating string in response to fluid pressure in the operating string to first release the lower wiper and plug means from the operating string and thereafter release the upper wiper and plug means from the operating string.

57. The arrangement of claim 56 wherein additional shear means longitudinally spaced from said shear means also connects the upper wiper means to the operating string.

58. The arrangement of claim 56 including further shear means to connect the lower wiper means to the operating string.

59. Apparatus to conduct a substance through the bore of an operating string wherein lower and upper wiper means are releasably supported on the operating string for sealably receiving lower and upper plug means for wiping ahead of and behind the substance, said apparatus comprising:

the upper wiper means extending into the operating string bore and the operating string extending into the upper wiper means to terminate adjacent the lower end of the upper wiper means and adjacent the upper end of the lower wiper means:

seals to close off communication between the operating string bore and the well bore when said lower plug means is engaged in said lower wiper means whereby pressure in the operating string is effective to actuate said shear means and release said engaged lower plug and wiper means from the operating string: and additional seals to close off communication between the operating string bore and the well bore when said upper plug means is engaged in said upper wiper means whereby pressure in the operating string is effective to actuate said shear means and release said engaged upper plug and wiper means from the operating string.

60. A method of cementing a liner in a well bore casing wherein the liner is sealably and releasably supported on an operating string having a bore for conducting cement into the well bore comprising the steps of:

positioning upper wiper means to sealably engage the bore of the operating string and to seal off communication between the operating string bore adjacent the upper wiper means and the well bore;

positioning lower wiper means to close off communication between the operating string bore adjacent the lower wiper means and the well bore;

connecting shear means on the operating string with each the upper and lower wiper means;

lowering the operating string with the wiper means thereon in the well bore;

releasing the liner from the operating string and suspending the liner on the casing in the well bore;

discharging lower plug means and cement into the operating string to wipe the operating string with cement therebehind;

sealably seating and locking the lower plug means in the lower wiper means and shearing the shear means by fluid pressure to release the lower wiper means with the lower plug means therein from the operating string by fluid pressure in the operating string for wiping the liner ahead of the cement;

discharging upper plug means into the operating string to wipe the operating string behind the cement;

sealably seating the upper plug means within the upper wiper means and shearing the shear means by fluid pressure to release the upper wiper means with the plug means therein from the operating string by fluid pressure in the operating string for wiping behind the cement; and discharging the cement from the liner into the well bore.

61. The method of claim 60 including the step of selectively rotating and/or reciprocating the liner in the well bore before releasing the liner from the operating string.

62. The method of claim 60 including the step of rotating the liner during and/or after cementing.

63. The method of claim 60 including the steps of selectively:

rotating and reciprocating the liner before cementing; and rotating the liner while cementing.

64. The method of claim 60 including the steps of:

catching the lower wiper and plug means in the liner prior to discharging cement from the liner into the well bore;

releasing the lower plug means from the lower wiper means and moving it longitudinally relative to the lower wiper means prior to discharging cement from the liner into the well bore; and securing the upper wiper and plug and lower wiper together as a unit after the cement is discharged from the liner into the well bore.

65. Apparatus to conduct a substance through the bore of an operating string wherein lower and upper wiper means are releasably supported on the operating string for sealably receiving lower and upper plug means for wiping ahead of and behind the substance, said apparatus comprising:

a seal arrangement to close off communication between the operating string bore adjacent the lower and upper wiper means and the well bore; and cooperating means on the operating string and each the lower and upper wiper means for releasably supporting each the lower and upper wiper means on the operating string.

66. The seal arrangement of claim 65 wherein said first seal means includes seal means between the bore of the operating string and the upper wiper means.

67. An arrangement for conducting a substance into a well bore through an operating string having a bore for receiving upper and lower plugs to sealingly seat, respectively, in upper and lower wiper means to isolate the substance therebetween prior to its discharge into the well bore, said arrangement comprising:

each the upper and lower wiper means including a body having a bore therethrough and annular wipers projecting outwardly therefrom;

shear means connecting each the upper and lower wiper means to the operating string;

first seal means between the bore of the operating string and the upper wiper means;

second seal means for closing off communication between the operating string adjacent the upper and lower wiper means and the well bore;

third seal means sealing off between the upper and lower wiper means; and the operating string including a plurality of circumferentially spaced fingers and wherein the lower wiper means includes recesses to receive said fingers to secure the operating string and the lower wiper means together against relative rotation.

68. The arrangement of claim 67 wherein said third seal means seals between the bodies of the upper and lower wiper means below the recesses in the lower wiper means which receive the circumferentially spaced fingers of the operating string.

69. The arrangement of claim 67 wherein the upper wiper means is provided with circumferentially spaced openings to receive the operating string therethrough.

70. The arrangement of claim 67 wherein the upper wiper means is provided with circumferentially spaced openings to receive the fingers of the operating string therethrough.

71. The arrangement of claim 67 wherein the upper wiper means has a portion extending through the operating string and into the bore thereof.

72. The arrangement of claim 67 wherein the upper wiper means has a portion extending between the circumferential spaced fingers of the operating string and into the bore thereof.

73. The arrangement of claim 67 wherein the operating string extends through the longitudinal bore of the upper wiper means to terminate, respectively, adjacent the lower and upper ends of the upper and lower wiper means, respectively, and in overlapping relation with the lower wiper means.

74. The arrangement of claim 67 wherein said shear means which connects the lower and upper wiper means to the operating string also secures the lower wiper means within the upper wiper means.

75. The arrangement of claim 67 wherein said shear means connects the upper and lower wiper means within the bore of the operating string below the smallest internal diameter of the bore of the upper wiper means.

76. The arrangement of claim 67 wherein said shear means connects the lower wiper means to the portion of the operating string which extends through the circumferential openings in the upper wiper means.

77. The arrangement of claim 67 wherein said shear means which connects said lower and upper wiper means to the operating string is located in substantially the same circumferential position and at substantially the same transverse position with respect to the operating string.

78. The arrangement of claim 67 wherein said shear means which connects said lower and upper wiper means to the operating string is located in substantially the same circumferential position and at substantially the same transverse position with respect to the operating string, and wherein said shear means which connects said lower wiper means to the operating string is also located at additional circumferentially spaced positions and at substantially the same transverse positions with respect to the operating string at which said means to releasably secure said upper wiper means is secured to the operating string is located.

79. The arrangement of claim 67 wherein said shear means which connects said upper and lower wiper means to the operating string is located in substantially the same circumferential position and at substantially the same transverse position in relation to the longitudinal axis of the operating string and wherein said shear means which connects one of said wiper means is located on the operating string at additional circumferentially spaced positions.

80. The arrangement of claim 67 wherein said shear means which releasably secures said upper and lower wiper means to the operating string is located at substantially the same transverse position in relation to the longitudinal axis of the operating string.

81. The arrangement of claim 67 wherein said shear means which connects said upper and lower wiper means to the operating string is located, respectively, at upper and lower longitudinally spaced positions on the operating string.

82. A method of conducting a substance to a well bore through an operating string having a bore for conducting the substance into the well bore comprising the steps of:

sealably positioning upper wiper means to seal off communication between the operating string adjacent the upper wiper means and the well bore;

positioning lower wiper means to sealably engage within the upper wiper means;

connecting shear means on the operating string with the each upper and lower wiper means to connect the upper and lower wiper means to the operating string;

lowering the operating string with the wiper means thereon in the well bore;

discharging lower plug means and a substance into the operating string to wipe the operating string with the substance therebehind;

sealably seating and locking the lower plug means in the lower wiper means and releasing the lower wiper means with the lower plug means therein from the operating string by fluid pressure in the operating string for wiping ahead of the substance;

discharging upper plug means into the operating string to wipe the operating string behind the substance;

sealably seating the upper plug means within the upper wiper means and releasing the upper wiper means with the plug means therein from the operating string by fluid pressure in the operating string for wiping behind the substance; and discharging the substance into the well bore.

83. An arrangement for conducting a substance into a well bore through an operating string having a bore for receiving lower and upper plugs to sealingly seat, respectively, in lower and upper wiper means to isolate the substance therebetween prior to its discharge into the well bore, said arrangement comprising:

each the upper and lower wiper means including a body having a bore therethrough and wipers projecting outwardly therefrom;

shear means connecting each the upper and lower wiper means to the operating string;

first seal means between the bore of the operating string and the upper wiper means;

second seal means to seal off communication between the operating string bore adjacent the upper and lower wiper means and the well bore;

third seal means sealing off between the upper and lower wiper means; and means to secure the operating string and the lower wiper means together against relative rotation.

84. The arrangement of claim 83 wherein the upper wiper means is provided with circumferentially spaced openings to receive the operating string therethrough.

85. In apparatus for conducting substances through the bore of an operating string into a well bore wherein lower and upper wiper means supported on the operating string sealably receive lower and upper plug means, respectively, for wiping ahead of and behind, respectively, the substances, said apparatus comprising:

a seal arrangement to close off communication between the operating string adjacent the lower and upper wiper means and the well bore, said arrangement including a seal between said upper and lower wiper means; and a plurality of shear means on the operating string connecting each said lower and upper wiper means to the operating string.

86. Apparatus for forming a closed system with the bore of an operating string for first releasing engaged lower plug and wiper means and then releasing upper plug and wiper means from the operating string to isolate a substance for discharge into a well bore comprising:

lower and upper spaced plug means for wiping operating string bore ahead of and behind, respectively, the substance;

lower and upper spaced wiper means with external means thereon for wiping ahead of and behind, respectively, the substance upon sealing engagement, respectively, with said lower and upper plug means;

a seal arrangement to close off communication between the operating string bore adjacent the lower and upper wiper means and the well bore;

said upper wiper means extending into the operating string bore and the operating string extending through the upper wiper means to terminate in overlapping relation with the lower wiper means whereby the upper and lower wiper means; and shear means connecting each said lower and upper wiper means to the operating string.

87. A method of cementing a liner in a well bore wherein the liner is releasably supported on an operating string having a bore for conducting cement into the well bore comprising the steps of:

positioning upper wiper means to sealably engage the bore of the operating string and to seal off communication between the operating string adjacent the upper wiper means and the well bore;

positioning lower wiper means to close off communication between the operating string bore adjacent the lower wiper means and the well bore;

connecting shear means on the operating string with each the upper and lower wiper means;

lowering the operating string with the wiper means thereon in the well bore;

releasing the liner from the operating string in the well bore;

discharging lower plug means and cement into the operating string to wipe the operating string with cement therebehind;

sealably seating and locking the lower plug means in the lower wiper means and shearing the shear means by fluid pressure to release the lower wiper means with the lower plug means therein from the operating string by fluid pressure in the operating string for wiping ahead of the cement;

discharging upper plug means into the operating string to wipe the operating string behind the cement;

sealably seating the upper plug means within the upper wiper means with the plug means therein from the operating string by fluid pressure in the operating string for wiping behind the cement;

moving the lower wiper and plug means through the liner to wipe the liner ahead of the cement;

moving the upper wiper and plug means through the liner to wipe the liner behind the cement; and discharging the cement from the liner into the well bore.

88. A method of releasably assembling lower and upper wiper and plug means on an operating string having a bore for isolating a substance as it is conducted and discharged to a selected region in a well bore comprising the steps of:

releasably positioning each the lower and upper wiper means on the operating string to receive the lower and upper plug means for wiping ahead of and behind the substance; and providing seals on the assembly to close off communication between the operating string bore adjacent the lower and upper wiper means and the well bore.

89. The method of claim 88 including the step of providing a seal between the upper wiper means and the bore of the operating string.

90. A method of preparing an assembly for conducting and discharging a substance through an operating string bore to a selected region in a well bore comprising the steps of:

releasably positioning each lower and upper wiper means on the operating string by shear means on the operating string to receive lower and upper plug means for wiping ahead of and behind the substance; and providing seals to close off communication between the operating string bore and the well bore when the lower and upper plug means is sealingly engaged, respectively, in the lower and upper wiper means.

91. Apparatus for conducting a substance through the bore of an operating string into a well bore wherein lower and upper wiper means are supported on the operating string and sealably receive lower and upper plug means for wiping ahead of and behind the substance, said apparatus comprising:

a seal arrangement to close off communication between the operating string bore adjacent the upper and lower wiper means and the well bore; and shear means releasably connecting each the lower and upper wiper means to the operating string.

* * * * *